United States Patent [19]

Haneda

[11] Patent Number: 4,734,735

[45] Date of Patent: Mar. 29, 1988

[54] IMAGE APPARATUS HAVING A COLOR SEPARATION FUNCTION

[75] Inventor: Satoshi Haneda, Hachioji, Japan

[73] Assignee: Konishiroku Photo Industry Co., Ltd., Tokyo, Japan

[21] Appl. No.: 897,730

[22] Filed: Aug. 18, 1986

[30] Foreign Application Priority Data

Aug. 23, 1985 [JP] Japan ..... 60-186435
Aug. 30, 1985 [JP] Japan ..... 60-192391
Aug. 30, 1985 [JP] Japan ..... 60-192393

[51] Int. Cl.[4] ..... G03G 15/01
[52] U.S. Cl. ..... 355/4; 355/3 DD; 355/14 D; 430/43
[58] Field of Search ..... 355/4, 32, 3 DD, 14 D; 430/42, 43, 44; 118/645

[56] References Cited

U.S. PATENT DOCUMENTS 4,515,462 5/1985 Yoneda ..... 355/4
4,619,518 10/1986 Kameyama et al. ..... 355/4

*Primary Examiner*—R. L. Moses
*Attorney, Agent, or Firm*—Jordan B. Bierman

[57] ABSTRACT

An image forming apparatus wherein an image exposure device, a whole surface exposure device by light of specific colors and a developing device, are disposed facing a photosensitive member having a surface insulating layer and provided with a color separation function in its surface. In the developing device, the operating condition is changed according to image forming modes. By the combination of the whole surface exposure and development, from an original image in specific colors a visible image in other colors can be provided.

8 Claims, 38 Drawing Figures

IMAGE APPARATUS HAVING A COLOR SEPARATION FUNCTION

BACKGROUND OF THE INVENTION

1. Field of the Invention

The present invention relates to an image forming apparatus and more particularly to an image forming apparatus for forming an image by electrophotography.

2. Description of the Prior Art

There have so far been proposed many types of such multicolor image forming apparatus forming images by means of electrophotography. These are broadly classified into the following groups. The first group is such that wherein electrostatic latent images for separated colors are formed and developed in succession for each of separated colors on a single photosensitive member, and all the colors are superimposed on the photosensitive member or a developed toner image is transferred therefrom to a transfer material each time the development takes place, and thereby, all the colors are superimposed on the transfer material. The second group is such that wherein a plurality of photosensitive members corresponding in number to the number of colors are provided and the toner images of the separated colors are simultaneously formed on these photosensitive members and then these images are transferred one by one to a transfer material and thereby a multicolor image is provided. In the latter case, it is advantageous that high-speed processing is made possible since toner images of multiple colors are simultaneously formed on the photosensitive members, but since a plurality of sets of photosensitive members, exposure means, and so on are required, the apparatus becomes more complex, larger in size, and more expensive, and hence, less practical. And, in either type of the above multicolor image forming apparatus, there is a great disadvantage that it is difficult to register the color images at the time of superimposing them, and therefore, it is impossible to completely eliminate the shear in the superimposition of colors.

To thoroughly solve these problems, the present inventor earlier invented an apparatus capable of forming a multicolor image by a single image exposure on a photosensitive member. The apparatus, using an electroconductive member, a photoconductive layer, a photosensitive member having a layer including a plurality of kinds of filters, forms a multicolor image as described below. That is, by providing the surface of the above mentioned photosensitive member with electric charges and an image exposure, an image (a primary latent image) is formed by variations in charge density on the boundary surface between an insulating layer and the photoconductive layer, and then by providing the image carrying surface with a whole surface exposure by specific light, that is, the beam of light passing through only one filter portion of the above mentioned plurality of kinds of filters, a potential pattern (a secondary latent image) is formed on the photosensitive member at the portion of the filter, and further by developing the potential pattern with a developing device containing a toner of a specific color, a single color toner image is formed. In succession thereto, by making another whole surface exposure by the beam of light passing through the filter portion different from that previously used and developing with another developing device containing a toner of different color from that used before, a toner image of the second color is formed on the photosensitive member. Thereafter, the whole surface exposure and development are repeated a required number of times. As a result, toners various colors are attached to various filter portions on the photosensitive member, and thus, a multicolor image is formed thereon (refer to Japanese Patent Application Nos. 59-83096 and 59-187044). According to this type of multicolor image forming apparatus, the image exposure is made only once, and therefore, there is really no possibility of occurrence of the shear in the colors superimposed.

In the above described multicolor image forming apparatus, reproduction of colors is carried out by not superimposing different colors on the same portion, namely, it is made through the so-called additive process. That is, the reproduction of black color by toners of three—yellow, magenta, and cyan—colors, for example, is performed by arranging these toners so that none of them is placed on another on a recording material and the black color is represented by composite reflected beams of light of these color components. High fidelity in color reproduction is obtained and the problem of the shear in the color images is solved by the present method, but in order to obtain good color balance, the potential contrast of the above mentioned potential pattern before development, which decides the attached amount of the toner, must be secured for each of the toners.

It has been known to produce a picture image of different colors from the original, that is, to make so-called color conversion. In such a case, the color conversion is achieved by changing the combination of the secondary latent image formed at a specific filter portion by the whole surface exposure by light of a specific color with the developing device containing a specific toner.

However, when the above mentioned combination is changed, the intervals of time between the image exposure, whole surface exposure, and development are changed from those when the color conversion is not practiced, and thereby, the color balance is largely affected.

The reason therefor is that, since a panchromatic photoconductive layer, having a sensitivity extended to the range of high wavelengths, exhibits in general no high electric resistance even at a dark place, the distributed electric charges on the boundary surface of the photosensitive layer trapped thereby vary with time due to neutralization by injection of electric charges from the substrate or escape of the electric charges to the conductive substrate, and so, the potential contrast of the potential pattern changes with the change of the intervals of time between the image exposure and the whole surface exposure. Occurrence of such a change is called dark decay. The degree of the dark decay depends upon the kinds of the photoconductive layers.

In the previously described conventional multicolor image formation, the image exposure, whole surface exposure, and development for one color only are performed in one rotation of the photosensitive member, and so, the above described problem does not occur even in practicing the color conversion. However, in the case of the multicolor image forming apparatus of the above described Japanese Patent Application Nos. 59-83096 and 59-187044, the primary latent image is formed for all colors at one time of image exposure, and therefore, the problem as described above occurs when the color conversion is practiced. So far, there has been given no consideration to the described problem.

SUMMARY OF THE INVENTION

A primary object of the present invention is the provision of an image forming apparatus which will retain the advantages of the invention according to the above described Japanese Patent Application Nos. 59-83096 and 59-187044 as they are and will additionally enable formation of monochromatic images as multicolor images and will provide good picture quality, density, and resolution, in whatever image forming mode the apparatus may be operated.

The above mentioned object of the present invention is achieved by an image forming apparatus comprising, disposed opposite to a photosensitive member having a surface insulating layer and provided with a color separation function in its surface, image exposure means, whole surface exposure means, and developing means of which operating conditions can be changed at least according to image forming modes.

The above mentioned "image forming modes" is to be understood, throughout this patent specification, to mean not only image forming modes of full color image, monochromatic image, neutral tints image, white and black image, and so on, but also selection of the color separation filter for forming the latent image and selection of the method for attaching the developer components for obtaining those images mentioned above and the system of image formation by combination of the above two selections.

Another object of the present invention is the provision of an image forming apparatus capable of constantly keeping good color balance and thereby forming a high quality image whether or not a color conversion is practiced.

The above mentioned object of the present invention is achieved by an image forming apparatus comprising, disposed opposite to a photosensitive member having a surface insulating layer and provided with a color separation function in its surface, image exposure means, whole surface exposure means, and developing means, wherein any difference between developing potential contrasts at portions in said photosensitive member corresponding to color components provided by color separation is within 30% of the maximum developing potential contrasts.

The above mentioned "potential contrast" means the absolute value of the difference between the maximum potential and the minimum potential in a potential pattern produced by a whole surface exposure and the above mentioned "developing potential contrast" refers to the potential contrast at the time developing is started.

A further object of the present invention is the provision of an image forming apparatus capable of forming an image of desired colors that are changed from the colors in the original image.

The above mentioned object of the present invention is achieved by an image forming apparatus comprising, disposed opposite to a photosensitive member having a surface insulating layer and a color separation function in its surface, image exposure means, whole surface exposure means, and developing means, wherein it is adapted such that, from an original image in specific colors, a visible image is provided in other colors by means of combination of the whole surface exposure and development.

Incidentally, the above mentioned "colors" not only cover chromatic colors but also cover achromatic colors such as white, gray, and black.

Other objects and features of the present invention will become more apparent from the description of preferred embodiments thereof in conjunction with the accompanying drawings.

DESCRIPTION OF THE PREFERRED EMBODIMENTS

Figure 1:
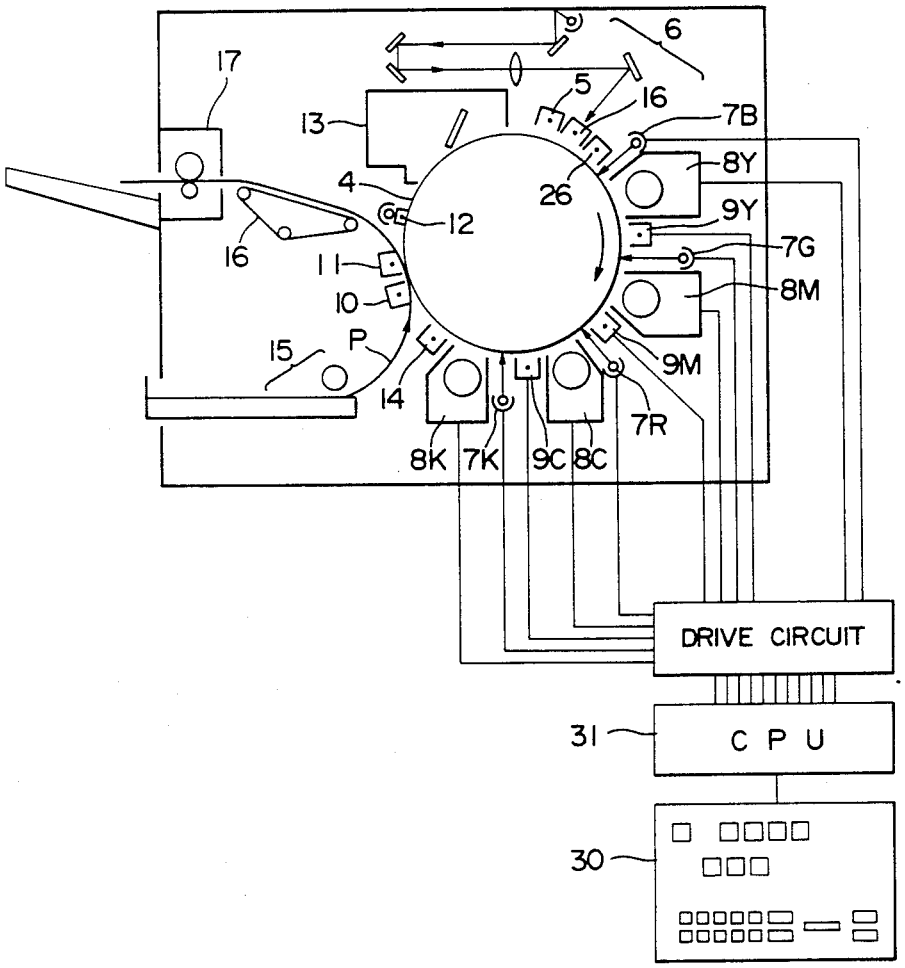
FIG. 1 is a schematic front view showing the interior of an image forming apparatus.
Figure 9:
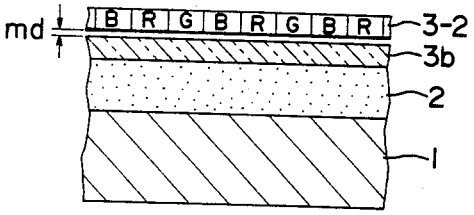
Figure 13:
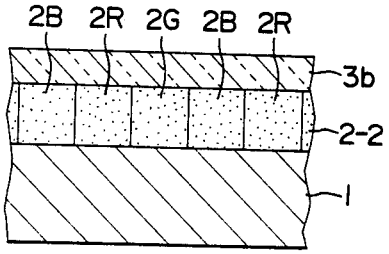
Figure 14:
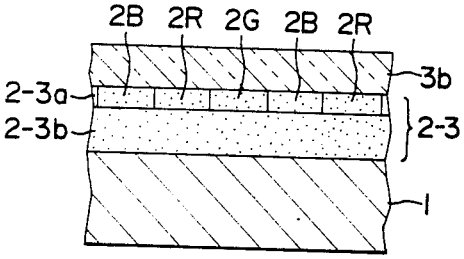
Figure 10:
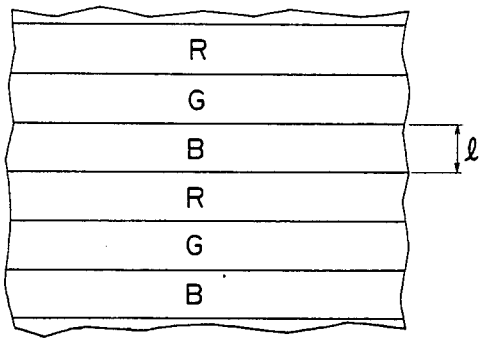
FIGS. 10, 11, and 12 are plan views of photosensitive members.
Figure 11:
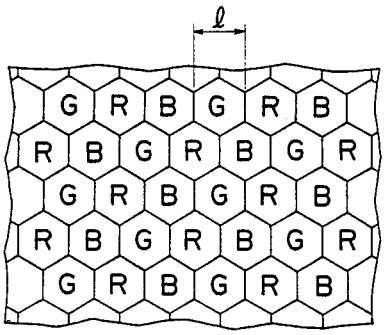
Figure 12:
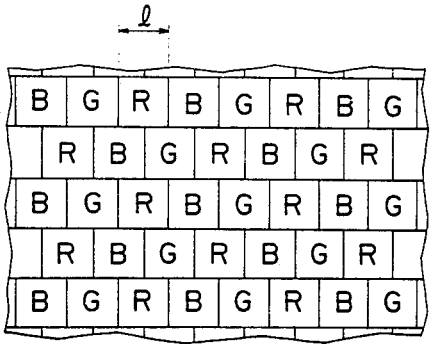
Figure 15A:
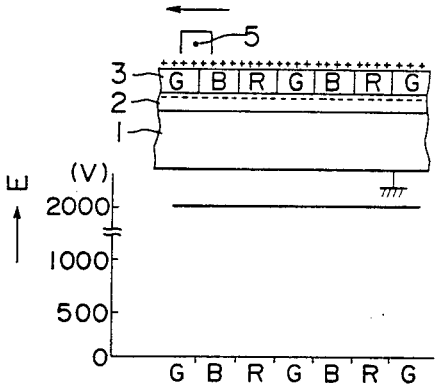
FIGS. 15(*a*), 15(*b*), 15(*c*), 15(*d*), 15(*e*), 15(*f*), 15(*g*) and 15(*h*) are process flow diagrams for explaining an image forming process.
Figure 15B:
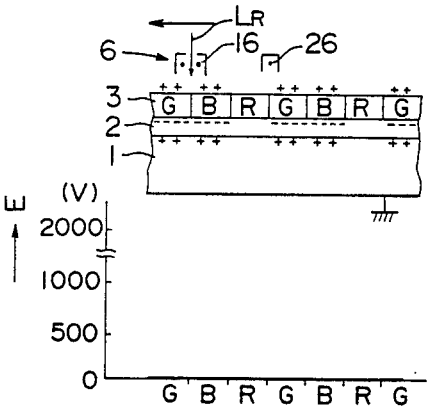
Figure 15C:
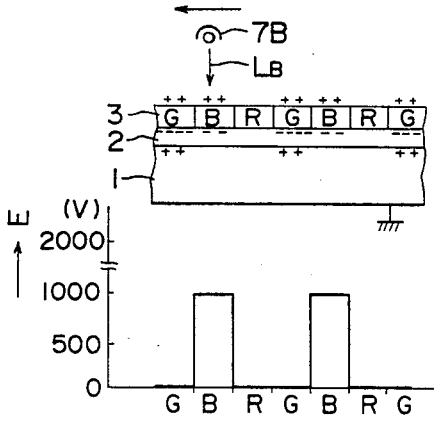
Figure 15D:
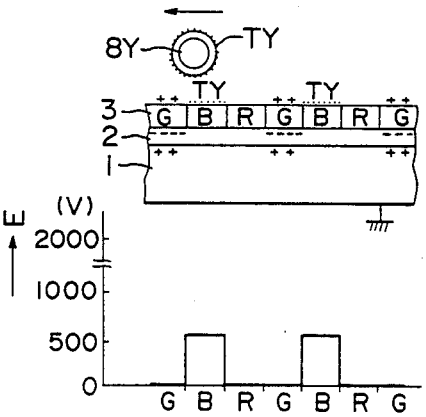
Figure 15:
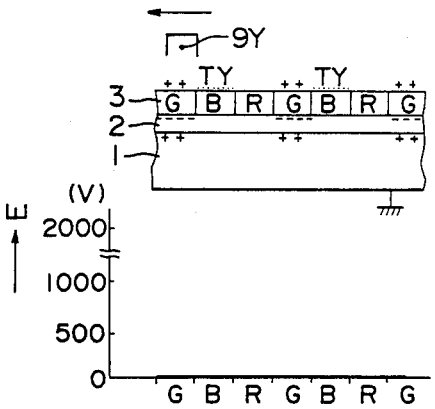
Figure 15:
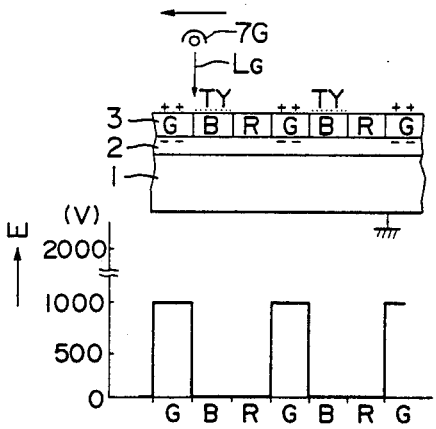
Figure 15:
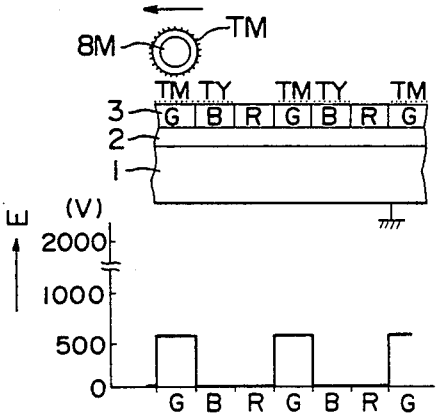
Figure 15:
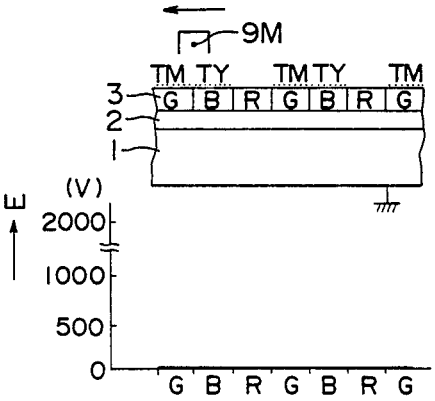
Figure 16:
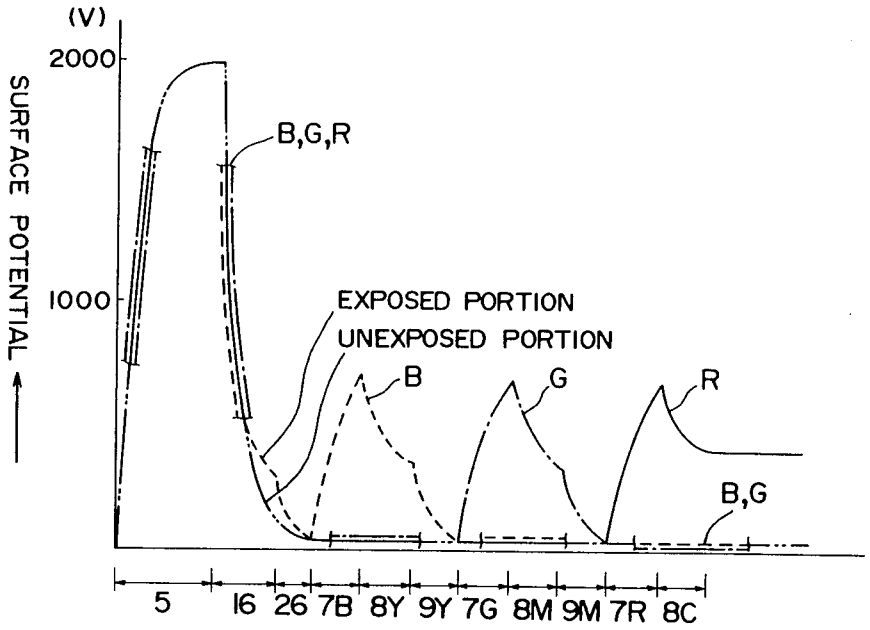
FIG. 16 is a graph showing change of surface potential on a photosensitive member in an image forming process.
Figure 17:
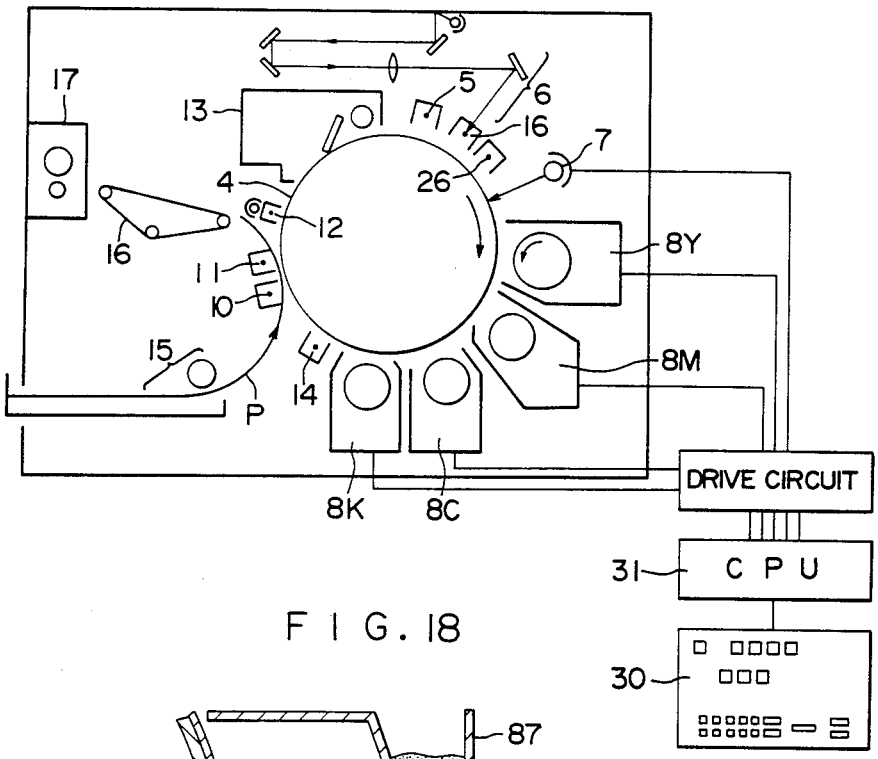
FIG. 17 is a schematic front view showing the interior of another image forming apparatus.
Figure 18:
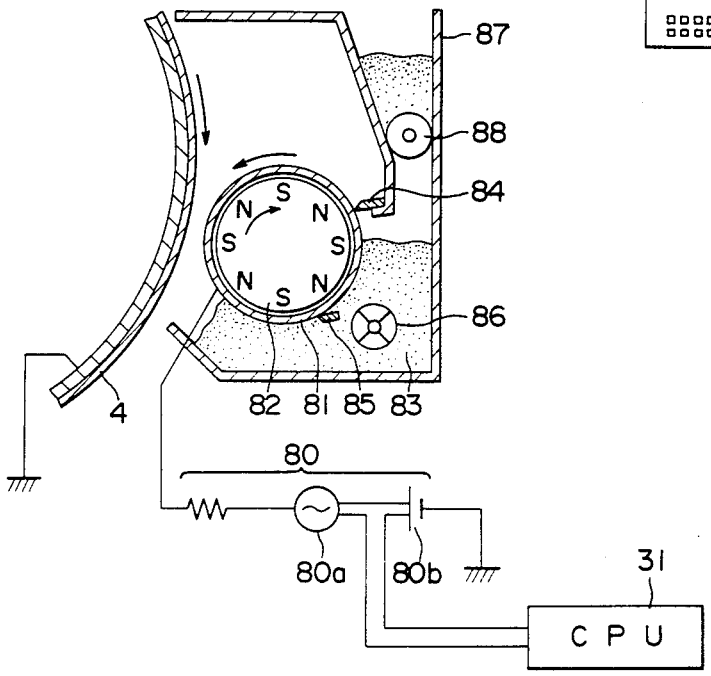
FIG. 18 is a sectional view of a developing device.

FIGS. 4 to 9 and FIGS. 13 and 14 are sectional views schematically showing structures of the photosensitive members used in the multicolor image forming apparatus of the invention and FIGS. 10 to 12 are plan view showing distribution examples of a plurality of kinds of filters in the insulating layer of the photosensitive member, FIGS. 1 and 17 are schematic structural drawings showing examples of the multicolor image forming apparatus of the present invention, FIG. 15 is a process diagram showing states in the image formation process in the multicolor image forming apparatus of the present invention, FIG. 16 is a graph showing the surface potential on the photosensitive member changing with time, i.e., with the progress of the process, and FIG. 18 is a partial drawing showing an example of the developing device for use in the multicolor image forming apparatus of the present invention.

Figure 4:
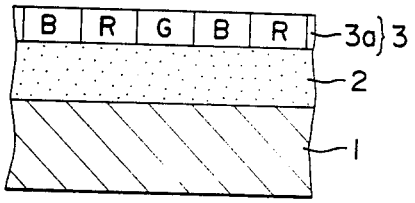
FIGS. 4, 5, 6, 7, 8, 9, 13, and 14 are sectional views of photosensitive members.
Figure 8:
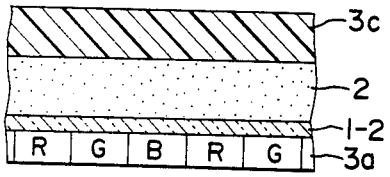
Figure 5:
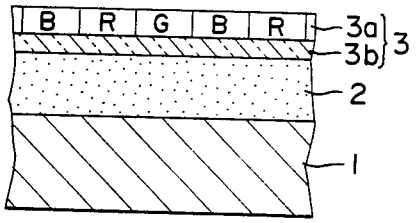
Figure 6:
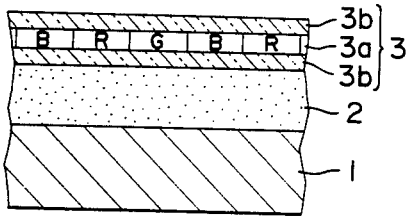
Figure 7:
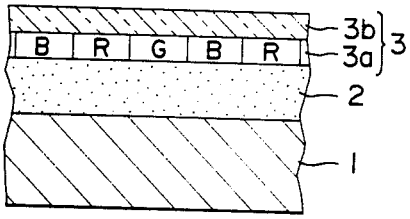

Referring to FIGS. 4 and 7, reference numeral 1 denotes a conductive substrate made of aluminum, iron, nickel, copper, or other metal or their alloy or the like and formed into a cylindrical, endless belt or other shape and structure, 2 denotes a photoconductive layer or a separated-function type photoconductive layer made up of a charge generation layer and a charge transfer layer, which is constituted of a photoconductive material such as sulfur, selenium, or amorphous silicon, or an alloy containing such elements as sulfur, selenium, tellurium, arsenic, antimony, or the like, an inorganic photoconductive material such as an oxide, iodide, sulfide, selenide, etc. of such metals as zinc, aluminum, antimony, bismuth, cadmium, and molybdenum, or an organic photoconductive material formed from organic photoconductive substance, such as vinyl carbazole, anthoracene phthalocyanine, trinitrofluorenone, polyvinyl carbazole, polyvinyl anthoracene, polyvinylpylene, etc., dispersed in an insulating binder resin such as polyethylene, polyester, polypropylene, polystyrene, polyvinyl chloride, polyvinyl acetate, polycarbonate, acrylic resin, silicone resin, fluorocarbon resin, epoxy resin, etc., and 3 denotes an insulating layer including a color separation filter layer 3*a* of such colors as red (R), green (G), and blue (B) formed of polymer, resin of various kinds and coloring agents such as dyestuff and pigment. The insulating layer 3 on the photosensitive member of FIG. 4 is formed by attaching insulating materials of resin or the like added with coloring agents to form a color separation filter attached onto the photoconductive layer 2 in a predertermined pattern by such a method as printing, the insulating layer 3 of the photosensitive member of FIG. 5 is fabricated by forming a filter layer 3*a* in a predetermined pattern on the surface of a transparent insulating layer 3*b* formed by a method hitherto known, the insulating layer 3 of the photosensitive member of FIG. 6 is fabricated in such a way that the filter layer 3*a* is sandwiched between transparent insulating layers 3*b*, and the insulating layer 3 of the photosensitive member of FIG. 7 is fabricated such that a filter layer 3*a* is formed on the side of the photoconductive layer 2 and a transparent insulating layer 3*b* is formed on the outer side thereof. These filter layers 3*a* are formed by such methods as printing, evaporation and photo-etching.

More particularly, the insulating layer 3 including the filter layer, the transparent insulating layer 3*b*, or the filter layer 3*a* may be fabricated such that such an insulating film or a film or sheet forming the filter is prepared and the same is attached or adhered onto the photoconductive layer 2 by a suitable method.

The photosensitive member can also be arranged in the structure as proposed by the present applicant (Japanese Patent Application No. 59-199547). As shown, for example, in FIG. 8, the same is fabricated in a laminated structure with an insulating layer 3*c* disposed on one surface of a photoconductive layer 2 and a light transmitting layer 1-2 and an insulating layer 3*a* formed of a color separation filter attached onto the other surface in the mentioned order. The light transmitting layer 1-2 is formed, for example, by evaporation of a metal. In the case of the photosensitive member of such a structure, the later discussed charging is made from the side of the insulating layer 3*c*, and the image exposure and whole surface exposure are made from the side of the insulating layer 3*a* formed of the color separation filter.

In the case, for example, of a drum type photosensitive member as shown in FIG. 9, a transparent insulating layer 3*b* may be provided on the photoconductive layer 2, and a layer 3-2 formed of the R, G, B filters (a layer similar to the above mentioned layer 3*a*) may be disposed thereover and coaxially therewith with a minute gap md left therebetween. That is, a cylindrical member 3-2 formed of the R, G, B filters is integrally put on the drum-formed photosensitive member having no filter with a minute gap left therebetween. By virtue of such a structure, any filter layers structured as shown in FIGS. 10, 11, and 12 (to be described later in detail) can be selected and exchanged for use. However, to prevent extreme blurring of the image projected through the filter cells onto the insulating layer and photoconductive layer, the gap md should not be made so large. And the transparent insulating layer 3*b* and the filter layer 3-2 need not be completely separated but may be in contact with each other.

The filter layer 3*a* formed in the insulating layer 3 with coloring agents, colored resin, or the like attached thereto is not specifically limited as to the form of its minute filters of colors R, G, B, etc. and their arrangement thereon. Striped distribution as shown in FIG. 10 is preferable from the point of view of ease in forming the pattern, and mosaic distribution as shown in FIGS. 11 and 12 is preferable because reproduction of a delicate multicolor image is achievable thereby. The filters of the colors R, G, B, etc. may be arranged in any direction with reference to the extended direction of the photosensitive member, even if they are of striped distribution, not to mention that of mosaic distribution. That is, in the case where the photosensitive member is a rotating drum type photosensitive member, the direction along the length of the stripes may be in parallel with, orthogonal to, or helical about the axis of the photosensitive member. As to the individual size of the filters R, G, B, etc., if it becomes too large, the resolution and color reproducibility are lowered to degrade the quality of the image, and if, conversely, the size becomes so small to be equal to or less than the particle size of the toner, the portion of one color becomes liable to be affected by the portion of other colors and also it becomes difficult to form the distributed pattern of filters. Therefore, it is desirable that each filter element is of a width or size of 10–500 $\mu$m in the portion indicated by l in the drawing.

It is preferred that each filter is highly resistive. In case where they are of low resistance, gaps are provided therebetween or insulating materials are interposed therebetween so that they may be electrically insulated.

Instead of using the layer 3*a* formed of a color separation filter as described above, a photosensitive member in which a photoconductive layer is provided with a color separation function may be used. FIGS. 13 and 14 show examples of photosensitive members previously proposed by the present applicant (Japanese Patent Application No. 59-201085). The photosensitive member of FIG. 13 is prepared such that a photoconductive layer 2-2 including a large number of photoconductive portions 2R, 2G, and 2B having necessary spectral sensitivity distribution, for example, photoconductive portions having sensitivities to the colors red (R), green (G), and blue (B), is formed on the substrate 1, and a transparent insulating layer 3*b* is provided thereover. The photosensitive member of FIG. 14 is structured such that a charge transfer layer 2-3*b* is formed on the substrate 1, a charge generation layer 2-3*a* made up of portions 2B, 2C, and 2G with different spectral sensitivity distribution is formed thereover, and a transparent insulating layer 3*b* is further provided over the same. In the photosensitive member of FIG. 14, the photoconductive layer 2-3 is made up of the charge generation layer 2-3*a* and the charge transfer layer 2-3*b*. The planar structure of the photoconductive layer 2-2 of FIG. 13 and the charge generation layer 2-3*a* of FIG. 14 may be of the planar structure the same as that shown in FIGS. 10, 11, and 12 like the above described insulating layer formed of the color separation filter.

To begin with, the principle of formation of multicolor image of the same colors as those of the original image on the photosensitive member of the above described structure will be described first with reference to FIG. 15. Incidentally, FIG. 15 shows the case where a photoconductive material of an n-type semiconductor such as cadmium sulfide is used for the photoconductive layer 2 of the photosensitive member, and reference numerals in FIG. 15 identical to those in FIGS. 4 to 7 denote members performing identical functions.

FIG. 15(*a*) shows the state of a photosensitive member 4 uniformly charged by positive corona discharge produced by a charging device 5. There are produced positive electric charges on the surface of the insulating layer 3, and responding to that, there are induced negative charges on the boundary layer between the photoconductive layer 2 and the insulating layer 3, and as a result, the electric potential on the surface of the photosensitive member 4 indicates uniform potential as shown in the graph showing potential E.

FIG. 15(*b*) shows the state of the above mentioned charged surface which is then subjected to an image exposure by an image exposure device 6. The drawing shows as an example a change in the charged surface at the portion irradiated by the red color component $L_R$. Since the red color component $L_R$ is transmitted through the R filter portion of the insulating layer 3 and renders the portion of the photoconductive layer 2 thereunder conductive, the charges on the surface of the insulating layer 3 and the negative charges on the boundary layer between the photoconductive layer 2 and the insulating layer 3 at that portion are erased by action of a charging device 16. Further, the potential pattern is sufficiently smoothed by a charging device 26. On the other hand, since the red color component $L_R$ is not transmitted through the G and B filter portions, the negative charges on the photoconductive layer 2 at these portions remain intact. Similar things occur for other color components of the image exposure. Thus, on the boundary layer between the insulating layer 3 and the photoconductive layer 2, there is formed a latent image of charge density corresponding to each color component transmitted through each filter. However, by action of the charging device 16 of the image exposure device 6 and the charging device 26, the potential on the surface of the photosensitive member is made even as seen from the graph showing the potential E regardless of the amounts of the electric charges on the boundary layer between the insulating layer 3 and the photoconductive layer 2, or, in other words, whether irradiated by the image exposure light or not. Similar results are obtained by the green color component and the blue color component of the image exposure light, and the state in which these results are accumulated is brought about as a consequence of the image exposure performed by the image exposure device 6, but from the state as it is, no function as an electrostatic image is provided.

FIG. 15(*c*) shows the state of the above mentioned image-exposed surface subjected to a uniform exposure of the blue light $L_B$ provided by a lamp 7B. Since the blue light $L_B$ is not transmitted through the R and G filter portions, these portions suffer no change, but since it passes through the B filter portion, the portion of the photoconductive layer 2 thereunder is rendered conductive, whereby the electric charges present upper and lower boundary layers of the photoconductive layer 2 are neutralized and, as a result, there appears a potential pattern giving an image for the complementary color to the blue color as a component of the previous image exposure at the B filter portion on the surface of the insulating layer 3 as indicated in the graph.

FIG. 15(*d*) shows the state of the potential pattern earlier formed by the whole surface exposure by the blue light $L_B$ now developed by a developing device 8Y containing negatively charged yellow toner TY. The yellow toner TY attaches only to the B filter portion where the potential was changed in the whole surface exposure step, and does not attach to the R and G filter portions since the potential was not changed there. Thus, a toner image of yellow color as one of the separated colors is formed on the surface of the photosensitive member 4. The potential on the B filter portion to which the yellow toner has been attached is lowered to a certain degree but the surface potential is not yet made even as shown in the graph.

FIG. 15(*e*) shows the state of the surface of the photosensitive member 4 with the yellow toner image formed thereon subjected to corona discharge produced by a charging device 9Y. The discharging made by the charging device 9Y lowers the potential on the B filter portion with the yellow toner TY attached thereto, and thereby, the surface potential is made even. The surface potential of the photosensitive member 4 is as shown in the graph.

Subsequently, the surface of the photosensitive member 4 with the yellow toner image formed thereon of FIG. 15(*e*) is subjected to a whole surface exposure by green light obtained from a lamp. And thereby, the same as described with reference to FIG. 15(*c*), a potential pattern appears now on the G filter portion. When this potential pattern is developed by a developing device containing magenta toner TM, the magenta toner attaches only to the G filter portion and a magenta toner image is formed like the case of FIG. 15(*d*). Thus, a two-color toner image is formed on the photosensitive member. Further, corona discharging is applied like the case of FIG. 15(*e*) onto the surface with the above described image formed thereon so that the surface potential is made even. These steps are shown in FIGS. 15(*f*), 15(*g*), and 15(*h*).

In succession, if the surface of the photosensitive member 4 with the two-color toner image formed thereon is subjected to a whole surface exposure by red light obtained by a lamp, then, a potential pattern appears in the same way as described in FIG. 15(*c*) now on the R filter portion, and if this potential pattern is developed by a developing device containing cyan toner, a cyan toner image may be formed. In this case, however, because it is a red color image, the potential pattern is not formed and the cyan toner does not attach thereto. Thus, a red color image is reproduced by the yellow toner and the magenta toner.

After completion of the above described process, a distinct trichromatic image with no shear in superimposed colors and no color turbidity is formed on the photosensitive member 4.

The results of the reproduction of an original image carried out as described above by the separated-three-color method with the yellow, magenta, and cyan toners are arranged in Table 1. Referring to Table 1, symbol "◌" indicates that the image pattern of charge density is formed on the boundary layer between the insulating layer 3 and the photoconductive layer 2, symbol "○" indicates that the potential pattern of the form of the image appears on the surface of the photosensitive member, and symbol "◍" indicates that the toner image is formed there. And, symbol "↓" indicates that the state indicated in the column just above is still maintained, and the blank column indicates absence of an image. Further, symbol "—" in the column "Attached Toner" indicates that no toner is attached and Y, M, and C indicate that yellow toner, magenta toner, and cyan toner, respectively, are attached.

the present image forming method, latent images are formed at the portions of the color separation filters which do not transmit therethrough the color component of the light from the original image and the latent images are developed.

Therefore, it becomes possible to achieve color conversion or to obtain various monochromatic images by selecting the exposure color of the whole surface exposure, the kind of development, or combination of these.

In the present image forming method, a monochromatic image can be formed by a toner attached to one or a plurality of the B, G, and R filter portions. Here, in the monochromatic color image formed by the toner attached to one or two of the above mentioned filter portions, the quantity of the attached toner is smaller than that in the image formed by an ordinary monochromatic copying machine.

TABLE 1

| Original | White | | | Red | | | Green | | | Blue | | | Yellow | | | Magenta | | | Cyan | | | Black | | |
|---|---|---|---|---|---|---|---|---|---|---|---|---|---|---|---|---|---|---|---|---|---|---|---|---|
| Filter in Insulating Layer | R | G | B | R | G | B | R | G | B | R | G | B | R | G | B | R | G | B | R | G | B | R | G | B |
| Image Exposure | | | | | ◌ | ◌ | ◌ | | ◌ | ◌ | ◌ | | | | ◌ | | ◌ | | ◌ | | | ◌ | ◌ | ◌ |
| Blue Whole Surface Exposure | | | | | ↓ | ○ | ↓ | | ○ | ↓ | ↓ | | | | ○ | | ↓ | | ↓ | | | ↓ | ↓ | ○ |
| Yellow Development | | | | | ↓ | ◍ | ↓ | | ◍ | ↓ | ↓ | | | | ◍ | | ↓ | | ↓ | | | ↓ | ↓ | ◍ |
| Green Whole Surface Exposure | | | | | ○ | | ↓ | | | ↓ | ○ | | | | | | ○ | | ↓ | | | ↓ | ○ | |
| Magenta Development | | | | | ◍ | | ↓ | | | ↓ | ◍ | | | | | | ◍ | | ↓ | | | ↓ | ◍ | |
| Red Whole Surface Exposure | | | | | | | ○ | | | ○ | | | | | | | | | ○ | | | ○ | | |
| Cyan Development | | | | | | | ◍ | | | ◍ | | | | | | | | | ◍ | | | ◍ | | |
| Attached Toner | — | — | — | — | M | Y | C | — | Y | C | M | — | — | — | Y | — | M | — | C | — | — | C | M | Y |
| Reproduction | White | | | Red | | | Green | | | Blue | | | Yellow | | | Magenta | | | Cyan | | | Black | | |

Further, FIG. 16 indicates changes in the surface potential on the B, G, R filter portions of the photosensitive member changing during the above described image forming process. In the graph, each of the portions 15, 16, 26, 7B, 8Y, 9Y, 7G, 8M, 9M, 7R, and 8C along the abscissa indicates the period during which the member corresponding to the mentioned reference character in FIG. 1 or 15 is in a step to act upon the photosensitive member 4 and B, G, and R indicates maximum, or minimum, potential at each filter portion. (In the above indication of elapse of time during the process, such periods of time between the primary charging and the secondary charging and between the whole surface exposure and the development are left out.)

Incidentally, FIG. 15 showed the example in which the photoconductive layer 2 of the photosensitive member 4 is formed of the n-type photo-semiconductor, but the image forming process does not differ in essence even if the device employs the p-type photosemiconductor, instead, such as selenium for the photoconductive layer 2, in which case only difference is that the positive and negative signs are reversed. And, in the case where the injection of electric charges is difficult at the time of charging photosensitive member 4, uniform irradiation by light may be used concurrently.

A method to obtain a monochromatic image from an original image (original picture) is as follows.

As seen from FIG. 15 and Table 1, in order to reproduce a color of the original image as it is according to As a case of forming a monochromatic image, the surface of the photosensitive member 4 undergone the image exposure of FIG. 15(*b*) is subjected to the whole surface exposure by blue light $L_B$ as shown in FIG. 15(*c*) and, in succession thereto, to another whole surface exposure by green light $L_G$, and further, to a whole surface exposure by red light $L_R$. And thereby, there is formed a potential pattern covering all of the B, G, and R filter portions. The pattern is developed by a developing device (containing yellow toner, magenta toner, cyan toner, or black toner). In this case, a high density image is obtained. Incidentally, the whole surface exposures can be made by any of one or two colors of blue light, green light, and red light. In such a case, since the toner is attached only to one or two filter portions, the then obtained image is low in density. Provision of a special purpose developing device is not necessary for developing a monochromatic image, but it may be developed by a developing device containing yellow toner, magenta toner, or cyan toner. And thereby, a yellow toner image, magenta toner image, or cyan toner image similarly excellent in image density and resolution can be formed.

The cases of forming monochromatic images by attaching toner to all of the B, G, and R filter portions are shown in the following Table 2 and Table 3. In the tables, reference character K in the column of "Attached Toner" indicates that the black toner is attached. Other symbols are the same as in Table 1.

TABLE 2

| Original | White | | | | | | Image | | | | | | | | |
|---|---|---|---|---|---|---|---|---|---|---|---|---|---|---|---|
| Filter in Insulating Layer | R | G | B | R | G | B | R | G | B | R | G | B | R | G | B |

TABLE 2-continued

| | | | | | | | | | | | | | | |
|---|---|---|---|---|---|---|---|---|---|---|---|---|---|---|
| Image Exposure | | | | | | | | | | | | | | |
| Blue Whole Surface Exposure | | | | ↓ | ↓ | ○ | ↓ | ↓ | ○ | ↓ | ↓ | ○ | ↓ | ○ |
| Green Whole Surface Exposure | | | | ↓ | ○ | ↓ | ↓ | ○ | ↓ | ↓ | ○ | ↓ | ↓ | ○ |
| Red Whole Surface Exposure | | | | ○ | ↓ | ↓ | ○ | ↓ | ↓ | ○ | ↓ | ↓ | ↓ | ○ |
| Yellow Development | | | | ◍ | ◍ | ◍ | ↓ | ↓ | ↓ | ↓ | ↓ | ↓ | ↓ | ↓ |
| Magenta Development | | | | | | | ◍ | ◍ | ◍ | ↓ | ↓ | ↓ | ↓ | ↓ |
| Cyan Development | | | | | | | | | | ◍ | ◍ | ◍ | ◍ | ◍ |
| Black Development | | | | | | | | | | | | | | ◍ |
| Attached Toner | — | — | — | Y | Y | Y | M | M | M | C | C | C | K | K |
| Reproduction | | White | | | Yellow | | | Magenta | | | Cyan | | | Black |

TABLE 3

| Original | | White | | | | | | | Image | | | | | |
|---|---|---|---|---|---|---|---|---|---|---|---|---|---|---|
| Filter in Insulating Layer | R | G | B | R | G | B | R | G | B | R | G | B | R | G | B |
| Image Exposure | | | | ○ | ○ | ○ | ○ | ○ | ○ | ○ | ○ | ○ | ○ | ○ |
| Blue Whole Surface Exposure | | | | ↓ | ↓ | ○ | ↓ | ↓ | ○ | ↓ | ↓ | ○ | ↓ | ↓ | ○ |
| Green Whole Surface Exposure | | | | ↓ | ○ | ↓ | ↓ | ○ | ↓ | ↓ | ○ | ↓ | ↓ | ○ | ↓ |
| Red Whole Surface Exposure | | | | ○ | ↓ | ↓ | ○ | ↓ | ↓ | ○ | ↓ | ↓ | ↓ | ↓ |
| Yellow Development | | | | ◍ | ◍ | ◍ | ↓ | ↓ | ↓ | ◍ | ◍ | ◍ | ◍ | ◍ | ◍ |
| Magenta Development | | | | ◍ | ◍ | ◍ | ◍ | ◍ | ◍ | ◍ | ◍ | ◍ | ↓ | ↓ | ↓ |
| Cyan Development | | | | | | | ◍ | ◍ | ◍ | ◍ | ◍ | ◍ | ◍ | ◍ | ◍ |
| Black Development | | | | | | | | | | | | | | | |
| Attached Toner | — | — | — | Y + M | Y + M | Y + M | M + C | M + C | M + C | Y + C | Y + C | Y + C |
| Reproduction | | White | | | Red | | | Blue | | | Green | |

Table 2 shows the examples of obtaining a monochromatic image of any of yellow, magenta, or cyan color, or a white and black image from a full color original. In the examples, three kinds of whole surface exposures are performed in succession and a kind of toner is attached by one selected developing device to all of the color separation filter portions, and thereby, the above mentioned monochromatic or white and black image is obtained.

Table 3 shows the examples of obtaining a monochromatic image of any of red, blue, or green color, or a white and black image from a full color original. In the examples, three kinds of whole surface exposures are performed in succession and two kinds of toners are attached by two selected developing devices to all of the color separation filter portions, and thereby, the above mentioned monochromatic or white and black image is obtained.

any red, blue, or green color, or a white and black image. After an image exposure has been made, a whole surface exposure is performed by the color to be decolored (red in the present examples), and then, two kinds of toners are attached by two selected developing devices to the portion of one kind of the color separation filter (the R filter portion in the present examples), and thereby, the above described monochromatic image or white and black image with a specific color decolored (red is decolored in the present examples) is obtained.

In order to obtain an monochromatic image of any of yellow, magenta, or cyan color with a specific color decolored, only one kind of developing device corresponding to that color is to be used as the developing device.

In the case where a specific color is decolored, the toner is attached only to the portion of one kind of the color separation filter transmitting the exposure light of

TABLE 15

| Original | | White | | | | | | | Image | | | | | |
|---|---|---|---|---|---|---|---|---|---|---|---|---|---|---|
| Filter in Insulating Layer | R | G | B | R | G | B | R | G | B | R | G | B | R | G | B |
| Image Exposure | | | | ○ | ○ | ○ | ○ | ○ | ○ | ○ | ○ | ○ | ○ | ○ | ○ |
| | | | | ↓ | ↓ | | ↓ | ↓ | ↓ | ↓ | ↓ | ↓ | ↓ | ↓ | ↓ |
| | | | | ↓ | | ↓ | ↓ | | ↓ | ↓ | ↓ | ↓ | ↓ | ↓ | ↓ |
| Red Whole Surface Exposure | | | | ○ | ↓ | ↓ | ○ | ↓ | ↓ | ○ | ↓ | ↓ | ○ | ↓ | ↓ |
| Yellow Development | | | | ◍ | ↓ | ↓ | ↓ | ↓ | ↓ | ◍ | ↓ | ↓ | ↓ | ↓ | ↓ |
| Magenta Development | | | | | ↓ | ↓ | ◍ | ↓ | ↓ | ↓ | ↓ | ↓ | ↓ | ↓ | ↓ |
| Cyan Development | | | | ◍ | ↓ | ↓ | | ↓ | ↓ | | ↓ | ↓ | ↓ | ↓ | ↓ |
| Black Development | | | | | ↓ | ↓ | ◍ | ↓ | ↓ | ◍ | ↓ | ↓ | ◍ | ↓ | ↓ |
| Attached Toner | — | — | — | YM | — | — | MC | — | — | YC | — | — | K | — | — |
| Reproduction | | White | | | Red | | | Blue | | | Green | | | Black | |

Table 15 shows an examples to decolor a specific color in a full color original (in the examples, red color is decolored and the red portion in the original is converted to white) and obtain a monochromatic image of the whole surface exposure therethrough, and so, the toner shows a tendency not to attach to the portion sufficiently to make the color thin. Therefore, it is desired that such a measure is taken at the time of development as to decrease the voltage of the D.C. component of the later discussed developing bias or to increase the voltage or decrease the frequency of the A.C. component of the same, so that the toner image density may be increased.

As so far described, in order to obtain a monochromatic image, there is no necessity for preparing a special purpose developing device for monochromatic development, but, by using a properly selected one or ones from the developing devices for full color development, a monochromatic image of yellow, magenta, cyan, red, blue, or green color which is excellent in image density and resolution can be formed.

The multicolor image forming apparatus of FIG. 1 is based on the above described principle for image formation, and forms a multicolor image in the following manner while the photosensitive member 4 in a drum form rotates one rotation in the direction indicated by the arrow. That is, the surface of the photosensitive member 4 is charged by the charging device 5 to a uniform potential, and the charged surface, while receiving an image exposure of white irradiating light from the image exposure device 6 reflected by an original, is subjected to A.C. or D.C. corona discharging of the opposite sign to the charging device 5 produced by the charging device 16, and thereby, the surface potential on the photosensitive member 4 is virtually flattened. In succession thereto, the surface potential on the photosensitive member 4 is made completely even by the charging device 26 similar to the charging device 16. Incidentally, the charging device 26 may be disposed adjacent to the charging device 16 of the image exposure device 6 on the downstream side thereof and both the members may be made integral with each other.

Then, the surface which has undergone the image exposure is uniformly irradiated by blue light $L_B$ obtained from the lamp 7B, whereby on the image exposed surface is formed a potential pattern for providing an image for complementary color to blue. This image is developed by the developing device 8Y containing yellow toner. In succession, the surface potential on the photosensitive member 4 is made even by action of the charging device 9Y producing corona discharge similar to that produced by the charging device 16. Then the surface is uniformly irradiated by green light $L_G$ obtained from the lamp 7G, and thereby, there is formed a potential pattern for providing an image for complementary color to green, and the image is developed by the developing device 8M containing magenta toner, and thereby, there is formed a two-color toner image on the surface of the photosensitive member 4. Then, similarly to the foregoing, discharging by the charging device 9M similar to that of the charging device 9Y, uniform irradiation of red light $L_R$ obtained from the lamp 7R, and development by the developing device 8C containing cyan toner are performed.

Through the above described process, there is formed an image of yellow, magenta, and cyan toner images superimposed on the photosensitive member 4. The thus formed multicolor toner image passes by the developing device 8K containing black toner, then held in an disabled state, without being affected thereby, is subjected to charging by a pre-transfer charging device 14 so as to be easily transferred, and transferred by a transfer device 10 to recording paper P which is fed in. The recording paper P with the multicolor image transferred thereto is separated from the photosensitive member 4 by a separating device 11, transferred by transferring means 16 to a fixing device 17, wherein the multicolor image is fixed, and discharged out of the machine. The surface of the photosensitive member 4 with the multicolor toner image transferred therefrom is deprived of electricity by a charge eliminating device 12 making irradiation and charging thereon, and then, cleared of residual toner thereon by a cleaning device 13 and is returned to the position ready for next image formation.

Since the whole surface exposure devices 7B (blue), 7G (green), and 7R (red) are disposed in the mentioned order, the intervals of time from the image exposure at a fixed location on the surface of the photosensitive member 4 through the whole surface exposure to the development are different from color to color. And so, in order to provide good color balance, it becomes necessary, as previously described, to arrange so that the developing potential patterns are not largely different from color to color. Good color balance is obtained when the difference between the maximum developing potential contrast and the minimum developing potential contrast is within about 15% of the maximum developing potential contrast. May it be larger than that, but if it is within 30%, it is possible to obtain good color balance by adjusting the developing conditions such as the developing bias according to each developing potential pattern.

In the multicolor image forming apparatus of FIG. 1, a monochromatic picture image is formed in the following manner. That is, with the charging devices 9Y, 9M, and 9C held in a disabled state, charging by the charging device 5, discharging and an image exposure by the charging device 16 and the charging device 26, and an whole surface exposure of blue, green, or red light from the lamp 7B or combination of them are performed similarly to the case of the multicolor image formation. And thereby, a potential pattern is formed on the whole surface of the photosensitive member 4. This pattern is developed by the developing device 8Y, 8M, or 8K, or a combination of the same, whereby a monochromatic toner image is obtained. Thereafter, similarly to the case of the multicolor image formation, the formed monochromatic toner image is transferred to recording paper P and fixed, while the surface of the photosensitive member 4 with the monochromatic toner image transferred therefrom is subjected to cleaning.

In the previously described multicolor image forming process, the whole surface exposure need not necessarily be made by the blue, green, and red light. That is, the electric charges on the boundary surface between the insulating layer and the photoconductive layer in the photosensitive member at the filter portion through which the whole surface exposure was transmitted have already been eliminated, and therefore, there is produced no change in the surface potential if another beam of light is transmitted therethrough. Therefore, even if, for example, the whole surface exposure is made in the order of red light, yellow light, and white light and the corresponding development is made in the order of cyan toner, magenta toner, and yellow toner, a multicolor image in which colors of the original are satisfactorily reproduced can be obtained. The colors of the whole surface exposures are not limited to those mentioned above, but lights of other spectral distribution can of course be used. By the way, when light of the whole exposure is transmitted through the same filter portion two times or more as in the above case, it is preferred that light irradiation is applied after the development thereby to completely eliminate the charges on the boundary layer between the insulating layer and the photoconductive layer. Thus, the light for the whole surface exposure can form the potential pattern only at the specific filter portion corresponding thereto.

Figure 3:
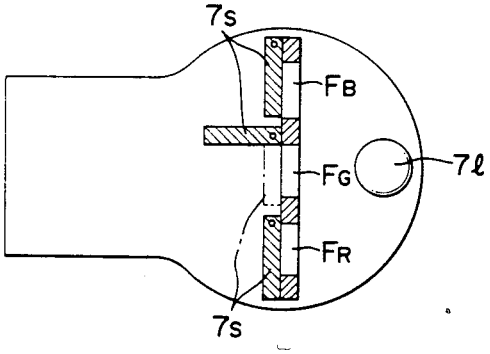
FIG. 3 is a sectional view of a whole surface exposure device.

As the whole surface exposure devices 7B, 7G, and 7R in FIG. 1, the one of the structure as shown in FIG. 3 capable of providing three kinds of monochromatic light is preferably used. The exposure device is provided with a white light source 7*l* and filters $F_B$, $F_G$, and $F_R$ which can be switched from one to another so that specific monochromatic light is emitted therefrom responding to a command from a later discussed central processing unit (CPU) (not shown).

Examples of color conversion to be made by the present apparatus will be described in the following.

The color conversion between blue and red, for example, can be performed by changing blue light for an image exposure to red light, and red light in another to blue light. Steps in the image formation relative to the color conversion are shown in Table 4. The symbols and characters in Table 4 (and in later described Table 5) represent the same things as represented by those in the above described Table 1.

TABLE 4

| Original | White | | | Red | | | Green | | | Blue | | | Yellow | | | Magenta | | | Cyan | | | Black | | |
|---|---|---|---|---|---|---|---|---|---|---|---|---|---|---|---|---|---|---|---|---|---|---|---|---|
| Filter in Insulating Layer | R | G | B | R | G | B | R | G | B | R | G | B | R | G | B | R | G | B | R | G | B | R | G | B |
| Image Exposure | | | | | ○ | ○ | | ○ | | | ○ | | | | ○ | | ○ | | | ○ | | | ○ | ○ |
| Red Whole Surface Exposure | | | | | | ↓ | | ○ | ↓ | ○ | ↓ | | | | ↓ | | ↓ | | | ○ | | ○ | ↓ | ↓ |
| Yellow Development | | | | | ↓ | ↓ | | ◍ | ↓ | ◍ | ↓ | | | | ↓ | | ↓ | | | ◍ | | ◍ | ↓ | ↓ |
| Green Whole Surface Exposure | | | | | ○ | ↓ | | | ↓ | | ○ | | | | ↓ | | ○ | | | | | | ○ | ↓ |
| Magenta Development | | | | | | ↓ | | | ↓ | | ◍ | | | | ↓ | | ◍ | | | | | | ◍ | ↓ |
| Blue Whole Surface Exposure | | | | | | ○ | | | ○ | | | | | | ○ | | | | | | | | | ○ |
| Cyan Development | | | | | | ◍ | | | ◍ | | | | | | ◍ | | | | | | | | | ◍ |
| Attached Toner | — | — | — | — | M | C | Y | — | C | Y | M | — | — | — | C | — | M | — | Y | — | — | Y | M | C |
| Reproduction | White | | | Blue | | | Green | | | Red | | | Cyan | | | Magenta | | | Yellow | | | Black | | |

Even in making the color conversion, it is preferred that differences between the developing potential contrasts is within the previously mentioned range. To achieve this, it becomes necessary that the potential contrast at the location of the developing device 8Y in the first stage is substantially equal no matter what exposure light of B, G, and R may be used for the whole surface exposure device 7B in the first stage and there is produced small dark decay. Unless these requirements are both met, the developing potential contrasts for the color conversion to be performed with the light for the whole surface exposure changed greatly vary and as a result good color balance become unobtainable.

More particularly, in order that the color conversion is performed well, the difference between the maximum developing potential contrast and the minimum developing potential contrast of those the developing potential contrasts corresponding to the light of specific colors for the whole surface exposure is to be within 30%, or more preferably within 15%, of the maximum developing potential contrast. Namely, it is preferred (maximum developing potential contrast − minimum potential contrast)/maximum developing potential contrast $\leqq$ 0.30, or specifically preferred (highest developing potential contrast − lowest potential contrast)/highest developing potential contrast $\leqq$ 0.15.

As described in the foregoing, the multicolor image forming apparatus of the invention not only provides a multicolor image free from shear in the colors superimposed but also forms a monochromatic image with excellent image density and resolution.

The multicolor image forming apparatus of FIG. 17 is such that a one-color toner image is formed during one rotation of the photosensitive member 4 and differs from the multicolor image forming apparatus of FIG. 1 in that the whole surface exposure is made by the lamp 7 of the structure as shown in FIG. 3, which is adapted such that the exposure devices for blue, green, and red light are used switched from one to another or simultaneously, and the surface potential on the photosensitive member 4 after the development is made even by the use of charging device 16 of the image exposure device 6. Also in this multicolor image forming apparatus, like in the multicolor image forming apparatus of FIG. 1, the image forming operations like those described in FIG. 15 are performed, and thereby, a multicolor image free from shear in the colors and a monochromatic image with excellent image density and resolution can be formed. That is, when a trichromatic image, for example, is to be formed, the photosensitive member 4 is charged by the charging device 5 and applied with an image exposure by the charging device 16 while the surface potential is made even. Then, a whole surface exposure of blue light from the lamp 7 is applied to the surface of the photosensitive member 4, and the potential image formed thereby is developed by the developing device 8Y and a yellow toner image is formed. This toner image passes by the developing devices 8M, 8C, and 8K, the pre-transfer charging device 14, transfer device 10, separating device 11, cleaning device 13, and the charging device 5 without being affected thereby. When the photosensitive member 4 with the toner image formed thereon arrives at the location of the charging device 16, it receives a corona discharge therefrom, and thereby, its surface potential is made even. It then receives a whole surface exposure of green light obtained from the lamp 7G, and thereby, a potential image is formed thereon. This image is then developed by the developing device 8M and a magenta toner image is formed. In like manner, formation of a potential pattern by red light and development by the developing device 8C are performed, and thus, a three-color toner image is obtained.

In the case of forming a monochromatic image, the photosensitive member 4 undergone the charging and image exposure is subjected to a whole surface exposure by blue, green, or red light or a combination of these from the lamp 7, whereby a potential pattern is formed on the surface of the photosensitive member 4, and the same is developed by one of the developing devices 8Y–8K or by a combination of these, and thus, a monochromatic image is obtained. The present multicolor image forming apparatus is provided in a structure as simple as that of an ordinary monochromatic copying machine except that the number of the developing devices is increased, and therefore, such advantages are obtained that the apparatus can be made in small size and at low cost. Identical reference characters in FIG. 17 to those in FIG. 1 denote members performing identical functions.

Even in the case of the multicolor image forming apparatus of FIG. 17, it is preferred, as was the case with the multicolor image forming apparatus of FIG. 1, that the difference between the developing potential contrasts for different colors is in the previously described range.

In the multicolor image forming apparatus of FIG. 17, during one rotation of the photosensitive member, the whole surface exposure and development are performed for only one color, and therefore, the interval of time for one sequence from the image exposure through the whole surface exposure to the development becomes longer as the sequence becomes that of the more rearward stage, and the degree of the prolongation of the interval is larger than that in the multicolor image forming apparatus of FIG. 1.

Therefore, when color conversion is made with the multicolor image forming apparatus of FIG. 17, the dark decay of the primary latent image comes into question. The color conversion can be performed in two ways, the one is by changing the order of the exposure colors for the whole surface exposure while keeping the order for development unchanged, and the other is by changing the order of the development while keeping the order for the exposure colors for the whole surface exposure.

In the prior art method, the interval of time from the image exposure through the whole surface exposure to the development suffers a greater change as compared with that when the color conversion is not made, and it follows that the degrees of dark decay greatly differ from color to color and the balance of the developing potential patterns between the colors come to be easily disturbed. For example, it occurs that, while the whole surface exposure and development for specific surface exposure light are performed during the first rotation of the photosensitive member when a color conversion is not made, the whole surface exposure and development are performed in the second or third rotation of the photosensitive member when the color conversion is made.

In the latter case, since what is changed is only the order of the development, the change in the potential pattern formed by the whole surface exposure is smaller because it is caused only by the distance between the developing devices, or the distances between the whole surface exposure device and the developing devices. And so, the dark decay is virtually out of the question and the developing potential pattern suffers only small change, and hence, this way is considered easier way for practicing the color conversion.

Steps of image formation in the case where color conversion between blue and red is performed are shown in Table 5 below.

TABLE 5

| Original | White | | | Red | | | Green | | | Blue | | | Yellow | | | Magenta | | | Cyan | | | Black | | |
|---|---|---|---|---|---|---|---|---|---|---|---|---|---|---|---|---|---|---|---|---|---|---|---|---|
| Filter in Insulating Layer | R | G | B | R | G | B | R | G | B | R | G | B | R | G | B | R | G | B | R | G | B | R | G | B |
| Image Exposure | | | | | | | | | | | | | | | | | | | | | | | | |
| Blue Whole Surface Exposure | | | | | ↓ | ○ | ↓ | | ○ | ↓ | ↓ | | | | ○ | | ↓ | | ↓ | | | ↓ | ↓ | ○ |
| Cyan Development | | | | | ↓ | ● | ↓ | | ● | ↓ | ↓ | | | | ● | | ↓ | | ↓ | | | ↓ | ↓ | ● |
| Green Whole Surface Exposure | | | | | ○ | | ↓ | | | ↓ | ○ | | | | | | ○ | | ↓ | | | ↓ | ○ | |
| Magenta Development | | | | | ● | | ↓ | | | ↓ | ● | | | | | | ● | | ↓ | | | ↓ | ● | |
| Red Whole Surface Exposure | | | | | | | ○ | | | ○ | | | | | | | | | ○ | | | ○ | | |
| Yellow Development | | | | | | | ● | | | ● | | | | | | | | | ● | | | ● | | |
| Attached Toner | — | — | — | — | M | C | Y | — | C | C | M | — | — | — | C | — | M | — | Y | — | — | Y | M | C |
| Reproduction | White | | | Blue | | | Green | | | Red | | | Cyan | | | Magenta | | | Yellow | | | Black | | |

As the developing device 8Y–8K to be used for such multicolor image forming apparatus as shown in FIG. 1 or FIG. 17, a magnet brush developing device as shown in FIG. 18 is favorably used.

The developing device of FIG. 18 is adapted such that at least either a developing sleeve 81 or a magnet member 82 provided with N and S poles disposed to face on the internal peripheral surface of the developing sleeve 81 is rotated, whereby the developer attracted by magnetic force of the magnet member 82 from a developer reservoir 83 onto the surface of the developing sleeve 81 is transferred in the direction indicated by the arrow. Midway through the transferring of the developer, the transferred amount thereof is regulated by a layer thickness regulating blade 84, whereby a developer layer is formed, and this developer layer develops the photosensitive member 4 according to the potential pattern formed thereon in the developing region where the developing sleeve opposes the photosensitive member 4. At the time of this development, the developing sleeve 81 is applied with a developing bias voltage from a bias power source 80 made up of an A.C. power source **80*a* and a D.C. power source 80*b*. According to the need, a bias voltage may be applied to the developing sleeve 81 even when the developing is not made to prevent transfer of the toner from the developing sleeve 81 to the photosensitive member 4 or from the photosensitive member 4 back to the developing sleeve 81. Or, at the off development period, the A.C. bias component applied when the developing is performed (at the on development period) may be cut off and only a D.C. bias component may be applied to the developing sleeve, the same may be put in a floating state or grounded, or a D.C. bias of like polarity to that of the toner may be applied thereto, or the developing device may be separated from the image retainer, or some of these measures may be used concurrently. Reference numeral 85 denotes a cleaning blade for scraping the developer layer off the developing sleeve 81 which has passed the developing region to return the developer to the developer reservoir 83, 86 denotes stirring means for stirring and uniformalizing the developer as well as for producing frictional electricity on the toner particles, 88 denotes a supply roller for supplying the toner from a toner hopper 87 to the developer reservoir 83**.

The developer used in such a developing device may be either that constituted only of a toner, so-called one-component developer, or that constituted of a toner and a magnetic carrier, so-called two-component developer. In developing, the method of making the developer layer, i.e., a magnetic brush, which directly slides along the surface of the photosensitive member may be used, but, in order that the previously formed toner image not be injured, it is preferable, specifically, at the second and later developing, to use such a method that the developer layer is kept out of contact with the photosensitive member such as, for example, described in specifications of U.S. Pat. No. 3,893,418 and Japanese Patent Laid-open No. 55-18656, and, in particular, of Japanese Patent Application Nos. 58-57446, 58-238295, and 58-238296. These methods are such that use one-component or two-component developer including a non-magnetic toner of which coloring can be freely chosen and makes the developing by means of alternating electric field produced within the developing region with the electrostatic image retaining member and the developer layer kept out of contact. The non-contact developing is performed with the distance between the developing sleeve and the photosensitive member made larger than the thickness of the developer layer (while they are kept at equal potential level) and under those various conditions as described above.

As the color toners for use in the developing, those for developing electrostatic images produced by known art can be used which are constituted of known binding resin in use for ordinary toner, coloring agent such as organic or inorganic pigment or dyestuff of various chromatic and achromatic colors, various magnetic additives, and the like, and as the carriers, various known carriers generally used for electrostatic images such as magnetic carriers of iron powder, ferrite powder, such powder coated by resin, magnetic material dispersed in resin, and the like can be used.

And, the developing method as described in Japanese Patent Application Nos. 58-249669 and 58-240066 earlier applied by the present applicant may also be used.

Now description will be given as to changes in the image density depending on the methods of image formation.

Figure 19:
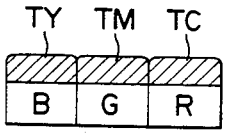
FIGS. 19, 20, 21, 22, 23, 24, and 25 are sectional views schematically showing states of toners attaching onto a color separation filter when operating conditions of a developing device are kept constant.

In case where, for example, a black original image is reproduced in a full color image forming mode, the black image is reproduced by yellow, magenta, and cyan toners attaching, respectively, onto B, G, and R filter portions as shown in FIG. 19 (refer to Table 1).

Figure 20:
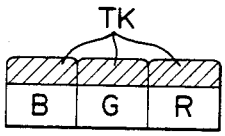

In the case where a white and black image is formed in a monochromatic mode, white light is used for the whole surface exposure and a black toner TK is attached to the B, G, and R filter portions as shown in FIG. 20 (refer to Table 2).

Figure 21:
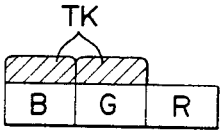
Figure 22:
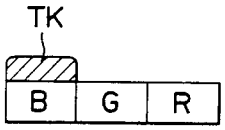

When it is adapted such that a white and black image is formed with a black toner attached only to two filter portions of the color separation filter as a variant of the method of Table 2, the state becomes as shown in FIG. 21. Likewise, in the case where a white and black image is formed only having a black toner attached only to one kind of filter portion of the color separation filter, the state becomes as shown in FIG. 22. The same thing holds for formation of other single color images. A monochromatic image of red, green, or blue color is formed by different colors of toners superimposed on the one and same latent image as shown in FIG. 23 or FIG. 24.

If FIGS. 20, 21, and 22 are developed under the same developing conditions, the image density is the highest with FIG. 20 (in which the attached amount of the toner is the largest) and the lowest with FIG. 22 (in which the attached amount of the toner is the smallest).

Figure 23:
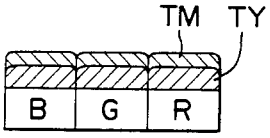

In the case where development in the monochromatic image forming mode is made by two kinds of toners, the second toner is attached onto the first toner image on all the color separation filter portions as shown in FIG. 23 (refer to Table 3).

Figure 24:
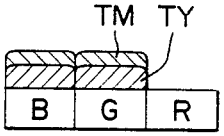
Figure 25:
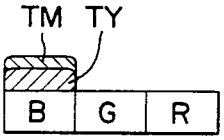

As variants of the method of Table 3, monochromatic images can be formed as shown in FIG. 24 and FIG. 25 similar to the foregoing. Also in the present cases, the image density is the highest with FIG. 23 and the lowest with FIG. 25.

Including also what have been described above, the image formation modes can be classified in the following groups:

(i) full color image formation (Table 1);

(ii) monochromatic image formation in which the whole surface exposure is applied with white light or a combination of blue, green and red light, and (ii-1) the development is made with one developing device (Table 2), (ii-2) with two developing devices (Table 3), or (ii-3) with three developing devices;

(iii) monochromatic image formation in which the whole surface exposure is applied with two-color light, and (iii-1) the development is made with one developing device, (iii-2) with two developing devices, or (iii-3) with three developing devices; and (iv) monochromatic image formation in which the full surface exposure is applied with one-color light, and (iv-1) the development is made with one developing device, (iv-2) with two developing devices, or (iv-3) with three developing devices.

In the monochromatic image formation, the amount of attached toner, and, hence, the image density changes depending on the manners of the whole surface exposure and development as exemplified in the foregoing. In the case, as shown in FIG. 23, where two kinds of toners are attached in two—lower and upper—layers onto the same color separation filter portion, the toner layer attached later becomes thinner than the toner layer previously attached, because when the latter toner layer is developed, the surface potential there has already been lowered by the earlier developed toner. When these layers are transferred to recording paper, the upper and lower sides are reversed, whereby the thinner layer formed in the later stage comes to be covered by the thicker toner layer formed in the earlier stage, and thus, it follows that the color of the later toner layer does not come out well and it becomes difficult to obtain a desired tone of colors.

As described above, there are cases where the amounts of attached toner are changed depending on the kinds of the image forming modes, and hence, image density or color tone at a desired level is hardly obtained. The present inventor, after investigations, found out that goood practice for bringing the attached amounts of the toner to a desired level and improving the color balance is:

(a) changing the voltage of the D.C. component of the developing bias;

(b) changing the voltage of the A.C. component of the developing bias;

(c) changing the frequency of the A.C. component of the developing bias;

(d) changing the duty ratio of the developing bias;

(e) changing the number of revolutions of the magnet member (one way to achieve this may be to change the number of revolutions of the developing sleeve, but this does not bring about a remarkable result);

(f) changing the thickness of the developer layer on the developing sleeve; and (g) changing the distance between the developing sleeve and the photosensitive member. Out of these, the method (f) or (g) makes the apparatus somewhat complex.

By way of example, a few of the above will be described below with reference to FIGS. 26, 27, and 28.

Figure 26:
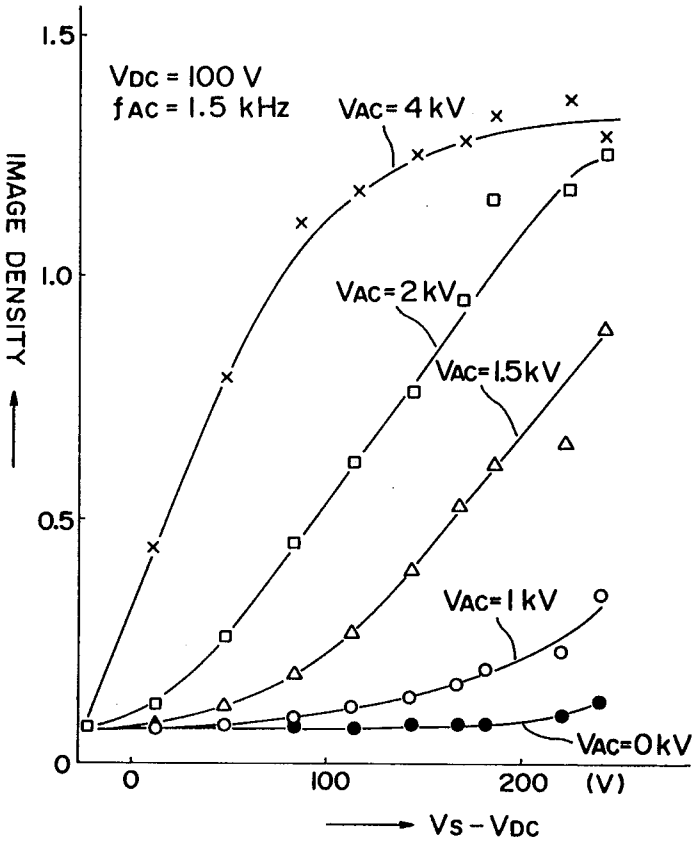
FIG. 26 is a graph showing relation between voltage of A.C. component of developing bias and image density.

FIG. 26 shows variations in the image density when the voltage of the D.C. component $V_{DC}$ of the developing bias was kept constant at 100 V and the frequency of the A.C. component was kept constant at 1.5 kHz, and when the potential on the photosensitive member $V_S$ and the voltage of A.C. component of the developing bias were varied.

Figure 27:
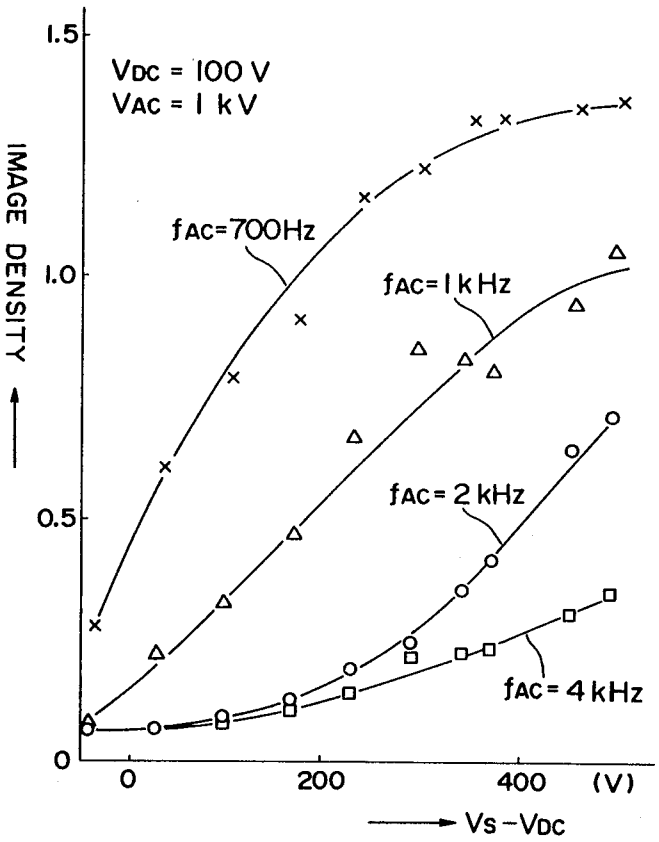
FIG. 27 is a graph showing relation between frequency of A.C. component of developing bias and image density.

FIG. 27 shows variations in the image density when the voltage of the D.C. component $V_{DC}$ of the developing bias was kept constant at 100 V and the voltage of the A.C. component $V_{AC}$ was kept constant at 1 kV, and when the frequency of the A.C. component was varied.

Figure 28:
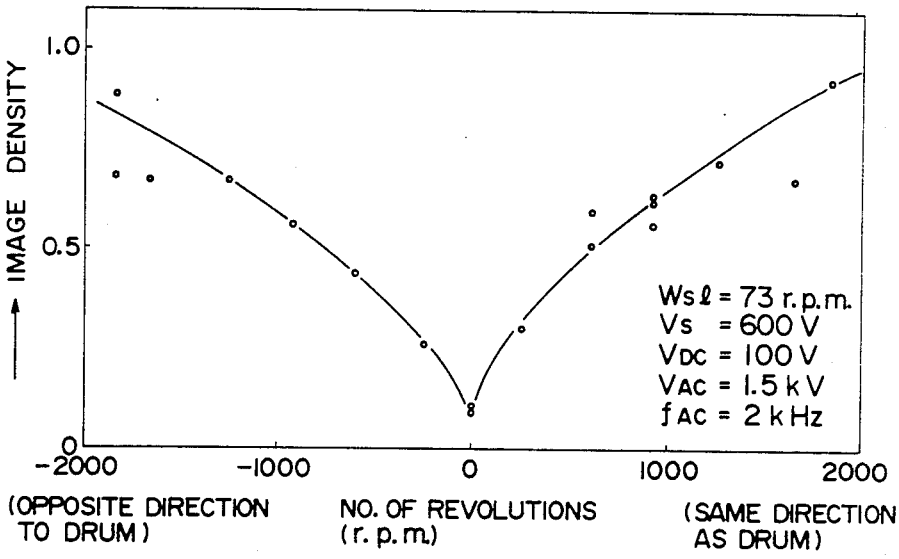
FIG. 28 is a graph showing relation between rotating speed of a magnetic member and image density.

FIG. 28 shows variations in the image density when the number of revolutions of the magnet member was varied while the following are kept constant, that is, the number of revolutions of the developing sleeve was kept at 73 rpm, the potential on the photosensitive member $V_S$ was kept at 600 V, the D.C. component of the developing bias was kept at 100 V, the voltage of the A.C. component was kept at 1.5 kV, and the frequency of the voltage of the A.C. component was kept at 2 kHz. Of the numbers of revolutions of the magnet member represented by the abscissa of the graph, the revolutions in the same direction as the developing sleeve are shown on the positive side and the revolutions in the opposite direction thereto are shown on the negative side.

From FIGS. 26, 27, and 28, it is known that the higher the voltage of the A.C. component of the developing bias, the lower the frequency of the A.C. component of the developing bias, and the higher the revolving speed of the magnet member, the higher becomes the image density. FIGS. 26 and 27 indicate that the image density becomes higher with the decrease in the voltage of the D.C. component of the developing bias.

Incidentally, those conditions which have not been described with reference to FIGS. 26, 27, and 28 above were the same as the conditions which will be described in the following concrete embodiments.

The concrete embodiments of the present invention will be described below.

EMBODIMENT 1

The photosensitive member 4 in the multicolor image forming device in FIG. 1 was constructed of, disposed on a conductive layer, a photoconductive layer made of CdS in a thickness of 40 μm and an insulating layer formed of R, G, and B filter portions distributed in a mosaic pattern as shown in FIG. 11, in which the length l of each filter was 200 μm and of which the thickness was 20 μm. The photosensitive member 4, given an outer diameter of 180 mm, was arranged to be rotated at 200 mm/sec of peripheral speed. The developing device 8Y, 8M, 8C, and 8K were of the structure as shown in FIG. 18, of which the developing sleeve 81, made of a non-magnetic stainless steel and given an outer diameter of 30 mm, was adapted to rotate at the time of development at 140 mm/sec of peripheral speed in the direction indicated by the arrow. The magnet member 82 was provided with eight pieces of N, S poles and adapted to provide the surface of the developing sleeve 81 with a maximum of 800 G of flux density and rotate at the time of the development at 600 rpm in the direction indicated by the arrow. The distance between the photosensitive member 4 and the surface of the developing sleeve 81 was made to be equally 0.75 mm for all of the developing devices 8Y, 8M, 8C, and 8K, and it was adapted such that a developer layer of a thickness of 0.3 mm was formed on the developing sleeve 81. The developer was formed of a toner with an average particle size of 10 μm and producing −10 to −20 μc/g of frictional electricity and a carrier formed from a resin with a magnetic material dispersed therein and having an average particle size of 25 μm and $10^{13}$ Ωcm or above of resistivity, the toner and the carrier being mixed in the ratio of 1:9 by weight. The colors of the toners for the developing devices 8Y, 8M, 8C, and 8K were naturally yellow, magenta, cyan, and black, respectively. As the charging device 5 was used a corotron discharging device, and as the charging devices 16 and 26 and the charging devices 9Y and 9M was used a scorotron discharging device. The charging device 5 was applied with a discharging voltage to bring the surface potential of the photosensitive member 4 to 1.5 kV, and the charging devices 16 and 26 and the charging devices 9Y and 9M were provided with charging voltages to bring the surface potential to 0 V.

Examples in which good image records were obtained for each image forming mode will be mentioned below. Under the above described conditions, the following image formation was made. The potential levels produced by the surface exposures with blue, green, and red light were all substantially equal, and they were 0 V at the white ground and +300 V at the colored ground.

MODE (i) MENTIONED ABOVE

In developing in the color image mode, blue, green, and red light was used for the whole surface exposure devices 7B, 7G, and 7R, and, correspondingly thereto, the developing devices 8Y, 8M, and 8C were used to form a full color image. The developing bias for each of the developing devices was:

| A.C. component | Frequency | D.C. component |
|---|---|---|
| 2 kV | 2 kHz | +100 V |

MODE (ii-1) MENTIONED ABOVE

In making development in the monochromatic image mode, beams of blue, green, and red light were concurrently used by the whole surface exposure device 7B and the development was made by one of the developing devices 8Y–8K.

The developing bias was:

| A.C. component | Frequency | D.C. component |
|---|---|---|
| 1.75 kV | 2 kHz | +100 V |

MODE (ii-2) MENTIONED ABOVE

Another developing device was used in addition to that in the above mode (ii-1).

The developing biases were:

| | A.C. component | Frequency | D.C. component |
|---|---|---|---|
| First one | 1.5 kV | 2 kHz | +150 V |
| Second one | 1.5 kV | 2 kHz | +100 V |

Note: the 'First one' above corresponds to the developing device which was used first.

Since it becomes difficult for the toner to be attached in the second development, the D.C. component was adjusted as above.

MODE (ii-3) MENTIONED ABOVE

A further developing device was used in addition to those in the above mode (ii-2), and thereby, a white and black image was formed with three toner layers of different colors piled up.

The developing biases were:

| | A.C. component | Frequency | D.C. component |
|---|---|---|---|
| First one | 1.5 kV | 2 kHz | +150 V |
| Second one | 1.5 kV | 2 kHz | +100 V |
| Third one | 1.5 kV | 2 kHz | +50 V |

MODE (iii-1) MENTIONED ABOVE

In making development in the monochromatic image mode, beams of light of two colors out of blue, green, and red were used for the whole surface exposure device 7B and the development was made by one of the developing devices 8Y–8K.

The developing bias was:

| A.C. component | Frequency | D.C. component |
|---|---|---|
| 2 kV | 2 kHz | +100 V |

MODE (iii-2) MENTIONED ABOVE

Another developing device was added to that in the above mode (iii-1).

The developing biases were:

| | A.C. component | Frequency | D.C. component |
|---|---|---|---|
| First one | 1.8 kV | 2 kHz | +150 V |
| Second one | 1.8 kV | 2 kHz | +100 V |

MODE (iii-3) MENTIONED ABOVE

A further developing device was used in addition to those in the above mode (iii-2), and thereby, a white and black image was formed with three toner layers of different colors piled up.

The developing biases were:

| | A.C. component | Frequency | D.C. component |
|---|---|---|---|
| First one | 1.8 kV | 2 kHz | +150 V |
| Second one | 1.8 kV | 2 kHz | +100 V |
| Third one | 1.8 kV | 2 kHz | +50 V |

MODE (iv-1) MENTIONED ABOVE

In making development in the monochromatic image mode, beams of light of one color out of blue, green, and red were used for the whole surface exposure device 7B and the development was made by one of the developing devices 8Y–8K.

The developing bias was:

| A.C. component | Frequency | D.C. component |
|---|---|---|
| 2.5 kV | 2 kHz | +100 V |

MODE (iv-2) MENTIONED ABOVE

Another developing device was added to that in the above mode (iv-1).

The developing biases were:

| | A.C. component | Frequency | D.C. component |
|---|---|---|---|
| First one | 2.3 kV | 2 kHz | +150 V |
| Second one | 2.3 kV | 2 kHz | +100 V |

MODE (iv-3) MENTIONED ABOVE

A further developing device was used in addition to those in the above mode (iv-2), and thereby, a white and black image was formed with three toner layers of different colors piled up.

The developing biases were:

| | A.C. component | Frequency | D.C. component |
|---|---|---|---|
| First one | 2.3 kV | 2 kHz | +150 V |
| Second one | 2.3 kV | 2 kHz | +100 V |
| Third one | 2.3 kV | 2 kHz | +50 V |

As described above, the voltage of the A.C. component of the developing bias was increased with the decrease in the number of the exposure color components in the whole surface exposure so that the quantity of the toner to be attached onto elements of the color separation filter was increased, and thereby, the decrease in the image density was prevented.

Figure 2:
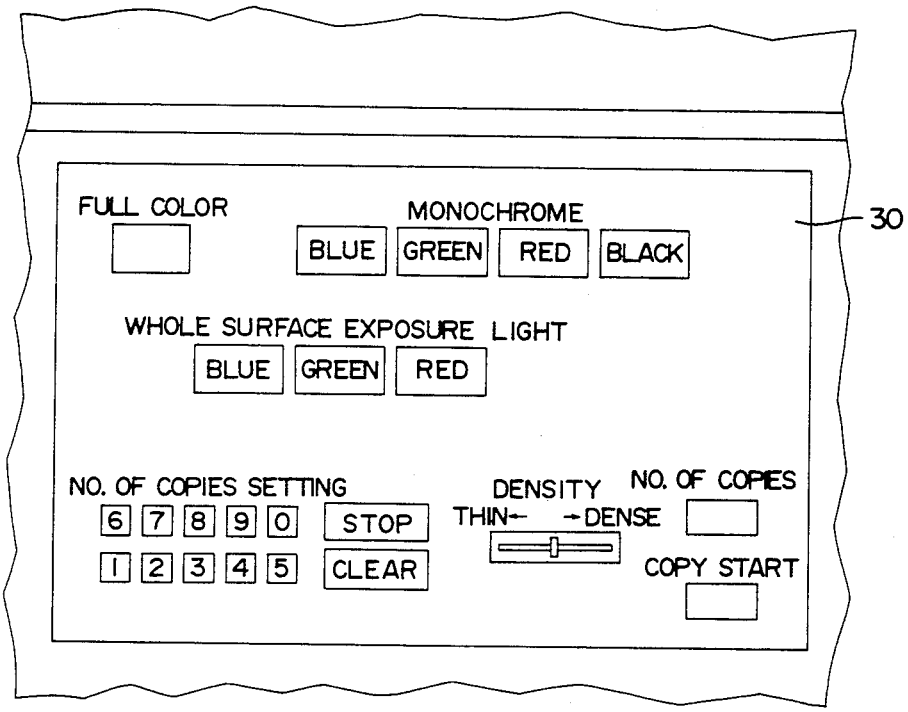
FIG. 2 is a plan view of a control panel.

The developing conditions suited for each of the image forming modes were investigated in detail as described above, and means for changing developing conditions according to the image forming modes was provided for the multicolor image forming apparatus. The means is made up of a control panel 30 and a central processing unit (CPU) 31 as shown in FIG. 1 and FIG. 17. An example of the control panel is shown in FIG. 2. And, the A.C. power source 80*a* and the D.C. power source 80*b* of the bias power source 80 in FIG. 18 and the drive device (not shown) of the magnet member 82 are connected to the CPU 31. In the multicolor image forming apparatus of FIG. 1 or FIG. 17, if an image forming mode is selected by an operation on the control panel 30, selection of color for the whole surface exposure and selection of developing conditions suited for the selected image forming mode are selected by the CPU 31 connected with the control panel 30, whereby each component part of the developing device connected to the CPU 31 is actuated under its control and formation of a good image is achieved. Although the A.C. voltage was changed in the above described embodiment, like effects can of course be obtained as indicated in FIGS. 26, 27, and 28, by changing the frequency of the A.C. component or the number of revolutions of the magnet roll in correspondence with the A.C. voltage.

The above described examples were all for the cases of normal development, but it is a matter of course that the present invention can be applied likewise to the photosensitive member having color separation function or the reversed image forming method as described in Japanese Patent Application Nos. 59-199547, 59-21084, 59-201085, and 59-187045.

As described so far, the image forming apparatus according to the present invention is structured such that it is at least provided with developing means for which operating (developing) conditions can be changed according to the image forming mode, and so, the quantities of the components of the developer to be attached onto the recording member can be controlled as desired. And therefore, an images of which color tone, density, and resolution are right fit for each of a variety of image forming modes can be formed.

And, the non-contact developing method by means of alternating electric field has a feature that the image density can be widely adjusted by regulating the alternating field strength. Particularly, when applied to the case where a two-component developer is used, the non-contact developing method provides preferable characteristics as seen in the following embodiments.

Therefore, it is, for example, practiced that reference patches of Y, M, C, and white or white and black colors are disposed on the back side of the document glass plate, and the reference patches are scanned prior to the scanning on the original, and thereby, reference latent images are formed on the photosensitive member. And, the potential (maximum potential and minimum potential) of each of the reference latent images which is produced by the whole surface exposure prior to the development is adapted to be detected by a potential sensor and fed back to the developing bias, whereby the image density is controlled.

Further, under the previously described conditions, potential contrasts were measured in the following manner. Since a P type photoconductive layer of Se-Te was used in this case, the positive and negative signs in FIG. 15 are all to be reversed.

As the whole surface exposure devices 7B, 7G, and 7R, the one as shown in FIG. 3 having a white light source 7L provided with filters of three colors FB, FG, and FR in front thereof adapted to be switchable by means of shutters 7S was used.

Taking the previously described steps, an image exposure from an white and black original was made, the surface potential was then flattened whereby a primary latent image was formed, the exposure light of the whole surface exposure device 7B in the first stage was switched from blue light through green light to red light in succession, and thereby, a secondary latent image was formed for each color component, and the potential patterns were measured by a surface electrometer which was disposed immediately before the developing device 8Y in the first stage. The measured results were as shown in Table 6 below.

TABLE 6 (V)

| | Blue Light | Green Light | Red Light |
|---|---|---|---|
| Black ground potential | −300 | −300 | −300 |
| White ground potential | −50 | −20 | −30 |
| Potential contrast | 250 | 280 | 270 |

Since the difference between the maximum potential contrast and the minimum potential contrast was 11% of the maximum potential contrast, it is known that the potential contrasts between colors were set without producing a great difference.

Then, the steps of the whole surface exposures in the image formation without making color conversion (blue light exposure by 7B, green light exposure by 7G, and red light exposure by 7R in this order) were taken and the secondary latent images were formed and the potential patterns thereof were respectively measured by surface electrometers disposed immediately before the developing devices 8Y, 8M, and 8C. The measured results were as shown in Table 7 below.

TABLE 7 (V)

| | Blue Light | Green Light | Red Light |
|---|---|---|---|
| Black ground potential | −300 | −250 | −200 |
| White ground potential | −50 | 0 | +10 |
| Potential contrast | 250 | 250 | 210 |

The difference between the maximum potential contrast and the minimum potential contrast was 16% of the maximum potential contrast and somewhat increased from that in Table 6. The decrease in the potential contrast in the last stage was due to the occurrence of the dark decay caused by leakage of the charges in the primary latent image trapped on the boundary surface of the photosensitive layer as well as the slight changes in the potential levels both in the black and white grounds cuased by the recharging treatments for flattening the potential after the development in the earlier stages (by 9Y and 9M). By comparing Table 7 with Table 6, it is known that the decrease in the potential contrast due to the dark decay between the developing devices was 30 V and the potential decrease by the recharging was 20 V.

Then, taking the steps of practicing color conversion between blue and red by making the whole surface exposure in the order from red light through green light and to blue light (previously mentioned Table 4), similar measurement was conducted. The measured results were as shown in Table 8 below.

TABLE 8 (V)

| | Red Light | Green Light | Blue Light |
|---|---|---|---|
| Black ground potential | −300 | −250 | −200 |
| White ground potential | −30 | 0 | −10 |
| Potential contrast | 270 | 250 | 190 |

The difference between the maximum potential contrast and the minimum potential contrast was 30% of the maximum potential contrast and further increased from that in the above Table 7. This increase was produced by the changed order of the whole surface exposure because the apparatus had been designed (as to amounts of exposure, spectral characteristics of the filters, etc.) from the beginning with the phenomenon of dark decay taken into consideration so as to provide equal developing potential contrasts for all the colors when there is made no such operation as the color conversion. Therefore, the changed order of the whole surface exposure produced such difference between the developing potential contrasts.

Reproduction of a full color original was made under the conditions of the above Table 1 and Table 4. Under the conditions of Table 1 in which no color conversion is made, a image with good color balance was obtained. Under the conditions of Table 4 in which color conversion between blue and red is made, the images obtained from both line drawings and pictures with continuous gradation such as portraits and landscapes provided substantially satisfactory color balance.

Through investigations of the above mentioned results, it has be known that good results will be obtained by setting the developing bias according to the potential patterns in the following manner.

The D.C. component $$V_{DC}=\text{white ground potential}+(-50\text{ V})$$

(The addition of −50 V is for preventing a fog.) As to the A.C. component (in the case where the frequency is fixed at 1.5 kHz), since the black ground potential is approximately −300 V as seen from Table 6, the available potential contrast according to FIG. 26 is $V_S-v_{DC}=200$ V, and therefore, in order to provide 1.0 of the image density, $V_{AC}=2$ kV is required. Namely, from FIG. 26, the A.C. component may be, qualitatively, varied in inverse proportional to $$|\text{black ground potential}-V_{DC}|,$$

and the coefficient is decided so that $V_{DC}=2.0$ KV may be obatined when $$|\text{black ground potential}-V_{DC}|=200\text{ V}.$$

Thus, $$V_{AC}=2.0\times 200/|\text{black ground potential}-V_{DC}|(kV).$$

According to the above equation, the developing potential is varied by inversely proportionating the amplitude of the A.C. component $V_{AC}$ according to the voltage of the D.C. component $V_{DC}$, and thereby, the variation in the developing potential contrast is compensated.

A color-converted reproduction of a full color original of the case of Table 8 was conducted with the developing biases set in accordance with the above equations, that is, $V_{DC}$ was set at −80 V and $V_{AC}$ was set at 1.82 kV for the developing device 8Y, $V_{DC}$ was set at −50 V and $V_{AC}$ was set at 2.0 kV for the developing device 8M, and $V_{DC}$ was set at −60 V and $V_{AC}$ was set at 2.86 kV for the developing device 8C. As the result, picture images with good color balance were obtained for both line drawing and image with gradation.

Further, the color conversion of Table 8 was conducted under the same conditions except that the material of the photoconductive layer was changed to Se-Te ($Se_{80}Te_{20}$) to reduce the dark decay and the developing potential contrasts were measured. The measured results were as shown in Table 9 below.

TABLE 9 (V)

| | Red Light | Green Light | Blue Light |
|---|---|---|---|
| Black ground potential | −300 | −250 | −220 |
| White ground potential | −30 | 0 | −10 |
| Potential contrast | 270 | 250 | 210 |

The difference between the maximum potential contrast and the minimum potential contrast was 22% of the maximum potential contrast and lower than that in the above Table 8.

In these circumstances, color conversion from a full color original was conducted under the developing conditions the same as those when the color conversion is not made. As a result, a substantially satisfactory image was obtained. And, when the developing biases were set according to the above mentioned equations, a high quality of image with excellent color balance was obtained.

For the sake of comparison, the developing potential contrasts were measured with the material of the photosensitive layer changed to Se-Te ($Se_{70}Te_{30}$) to increase the dark decay and otherwise under the same conditions as in the color conversion of Table 8, and results were obtained as shown in Table 10 below.

TABLE 10 (V)

| | Red Light | Green Light | Blue Light |
|---|---|---|---|
| Black ground potential | −300 | −230 | −170 |
| White ground potentail | −30 | 0 | −10 |
| Potential contrast | 270 | 230 | 160 |

The difference between the maximum potential contrast and the minimum potential contrast was 41% of the maximum potential contrast and still larger than that in the above Table 8.

In these circumstances, color conversion from a full color original was conducted under the developing conditions the same as those when the color conversion is not made. The images obtained as the result of the foregoing were such that lacked color balance even if it was for a line drawing, not to mention a picture with gradation, and, although the developing biases were then changed according to the above mentioned equations, satisfactory image quality was not obtained.

As to the developing potential contrast, it will be understood from these results that, if the difference between the maximum developing potential contrast and the minimum developing potential contrast for the different color components is less than 30% of the maximum developing potential contrast, good color balance can be maintained through adjustment of the developing biases, and if it is within around 15%, good color balance is obtained without the need for specifically adjusting the developing biases. In order to constantly obtain a image of better quality, however, it is preferable that the developing conditions are always adjusted as described in the foregoing. For practicing this, there are attached reference patches of Y, M, C, and white colors on the backside of the document glass table at its front end and there are disposed surface electrometers immediately before the developing devices 8Y, 8M, and 8C, and it is adapted such that the bias power source (A.C. power source and D.C. power source) is controlled by way of the input circuit and the central processing unit (CPU) based on the detected results by the surface electrometers.

EMBODIMENT 2

The present embodiment is of the measurements conducted with the multicolor image forming apparatus of FIG. 17 in the same way as in the above described embodiment 1.

In the present multicolor image forming apparatus, the order of the whole surface exposure was made to be from blue through green to red for the reason as previously described, and the order of the development when color conversion was not practiced was from yellow through magenta to cyan, and in the case where the color conversion between blue and red was practiced, the developing order was made from cyan through magenta to yellow (refer to Table 3). Therefore, in the present apparatus, the variations in the intervals between the developing stages following the whole surface exposures after the image exposure were smaller since the order of the development only was changed in the present case. As the material of the photoconductive layer, Se-Te ($Se_{80}Te_{20}$) was used. Other conditions were the same as in the previously described embodiment 1.

The potential contrasts obtained when the color conversion was not made are shown in Table 11 below and those when the color conversion between blue and red was made are shown in Table 12 succeeding thereto.

(i) When color conversion was not made:

TABLE 11 (V)

| | Developing devices | | |
|---|---|---|---|
| | 8Y | 8M | 8C |
| Black ground potential | −300 | −250 | −200 |
| White ground potential | −50 | 0 | +10 |
| Potential contrast | 250 | 250 | 210 |

The difference between the maximum potential contrast and the minimum potential contrast was 16% of the maximum potential contrast. Under these conditions, reproductions were produced from full color original, and they were of good quality for both line drawing and picture with gradation.

(ii) When color conversion between blue and red was made:

TABLE 12 (V)

| | Developing devices | | |
|---|---|---|---|
| | 8C | 8M | 8Y |
| Black ground potential | −300 | −250 | −200 |
| White ground potential | −60 | 0 | 0 |
| Potential contrast | 240 | 250 | 200 |

The difference between the maximum potential contrast and the minimum potential contrast was 17% of the maximum potential contrast. A color-converted image was formed from a full color original under the developing conditions the same as those when the color conversion is not made and the obtained image was of satisfactory quality. Then, with the developing biases adjusted according to the previously described equations, high quality picture images were obtained for both line drawing and picture with gradation.

Thus, with the multicolor image forming apparatus of FIG. 17, similar results to those obtained with the apparatus of FIG. 1 were obtained.

As described so far, the image forming apparatus according to the present invention is provided with a photosensitive member including a surface insulating layer and having a color separation function, and therein, it is adapted such that differences in developing potential contrast between portions on the photosensitive member corresponding to the color components provided by color separation are within 30% of the maximum potential contrast, and therefore, it is made possible to make the attached amounts of the toner in all the development stages are not so much different from each other. Thus, an image of high quality in which shear in colors is never be produced and color balance is good whether color conversion is made or not can obtained.

A further embodiment of the present invention will be described in the following.

In the example of Table 4, the order of the whole surface exposure is from red light through green light to blue light. Consequently, for the red portion in the original, the magenta toner is attached to the G filter portion and the cyan toner is attached to the B filter portion and color conversion to blue color is achieved by these two toners. For the green portion in the original, the yellow toner is attached to the R filter portion and the cyan toner is attached to the B filter portion, and green color is reproduced by these two toners. For the blue portion in the original, the yellow toner is attached to the R filter portion and the magenta toner is attached to the G filter portion and color conversion to red color is achieved thereby. Thus, the red color portion and blue color portion in the original are converted to each other. Further, the yellow portion in the original is converted to cyan color and the cyan portion in the original is converted to yellow color, while the magenta portion and black portion in the original are reproduced in the original colors as they are.

As seen by comparing Table 4 with the earlier mentioned Table 1, by changing the order of the whole surface exposures, the kinds of toners to be attached to some filter portions are changed, and thereby, some colors in the original are converted to other colors, while some other colors are reproduced in the original colors as they are. These things hold also for Table 13 and Table 14.

TABLE 13

| Original | White | | | Red | | | Green | | | Blue | | | Yellow | | | Magenta | | | Cyan | | | Black | | |
|---|---|---|---|---|---|---|---|---|---|---|---|---|---|---|---|---|---|---|---|---|---|---|---|---|
| Filter in Insulating Layer | R | G | B | R | G | B | R | G | B | R | G | B | R | G | B | R | G | B | R | G | B | R | G | B |
| Image Exposure | | | | ○ | ○ | ○ | | | ○ | ○ | ○ | | | | ○ | | ○ | | ○ | | | ○ | ○ | ○ |
| Red Whole Surface Exposure | | | | | ↓ | ↓ | ○ | | | ↓ | ○ | ↓ | | | ↓ | | ↓ | | ○ | | | ○ | ↓ | ↓ |
| Yellow Development | | | | | ↓ | ↓ | ⊘ | | | ↓ | ⊘ | ↓ | | | ↓ | | ↓ | | ⊘ | | | ⊘ | ↓ | ↓ |
| Uniform Charging | | | | | ↓ | ↓ | | | | ↓ | | ↓ | | | ↓ | | ↓ | | | | | | ↓ | ↓ |
| Blue Whole Surface Exposure | | | | | ↓ | ○ | | | | ○ | | ↓ | | | ○ | | ↓ | | | | | | ↓ | ○ |
| Magenta Development | | | | | ↓ | ⊘ | | | | ⊘ | | ↓ | | | ⊘ | | ↓ | | | | | | ↓ | ⊘ |
| Uniform Charging | | | | | ↓ | | | | | | | ↓ | | | | | ↓ | | | | | | ↓ | |

TABLE 13-continued

| | | | | | | | | | | | | | | | | | | | | | | | | |
|---|---|---|---|---|---|---|---|---|---|---|---|---|---|---|---|---|---|---|---|---|---|---|---|---|
| Green Whole Surface Exposure | | | | | ○ | | | | | | ○ | | | | | | ○ | | | | | | ○ | |
| Cyan Development | | | | | ◍ | | | | | | ◍ | | | | | | ◍ | | | | | | ◍ | |
| Attached Toner | — | — | — | — | C | M | Y | | M | Y | C | | — | — | M | — | C | — | Y | — | — | Y | C | M |
| Reproduction | | White | | | Blue | | | Red | | | Green | | | Magenta | | | Cyan | | | Yellow | | | Black | |

TABLE 14

| | | | | | | | | | | | | | | | | | | | | | | | | |
|---|---|---|---|---|---|---|---|---|---|---|---|---|---|---|---|---|---|---|---|---|---|---|---|---|
| Original | | White | | | Red | | | Green | | | Blue | | | Yellow | | | Magenta | | | Cyan | | | Black | |
| Filter in Insulating Layer | R | G | B | R | G | B | R | G | B | R | G | B | R | G | B | R | G | B | R | G | B | R | G | B |
| Image Exposure | | | | | ◌ | ◌ | ◌ | | ◌ | ◌ | ◌ | | | | ◌ | | ◌ | | ◌ | | | ◌ | ◌ | ◌ |
| Green Whole Surface Exposure | | | | | ○ | ↓ | ↓ | | ↓ | ↓ | ○ | | | | ↓ | | ○ | | ↓ | | | ↓ | ○ | ↓ |
| Yellow Development | | | | | ◍ | ↓ | ↓ | | ↓ | ↓ | ◍ | | | | ↓ | | ◍ | | ↓ | | | ↓ | ● | ↓ |
| Uniform Charging | | | | | | ↓ | ↓ | | ↓ | ↓ | | | | | ↓ | | | | ↓ | | | ↓ | ↓ | |
| Red Whole Surface Exposure | | | | | | ↓ | ○ | | ↓ | ○ | | | | | ↓ | | | | ○ | | | ○ | | ↓ |
| Magenta Development | | | | | | ↓ | ◍ | | ↓ | ◍ | | | | | ↓ | | | | ◍ | | | ◍ | | ↓ |
| Uniform Charging | | | | | | ↓ | | | ↓ | | | | | | ↓ | | | | | | | | | ↓ |
| Blue Whole Surface Exposure | | | | | | ○ | | | ○ | | | | | | ○ | | | | | | | | | ○ |
| Cyan Development | | | | | | ◍ | | | ◍ | | | | | | ◍ | | | | | | | | | ◍ |
| Attached Toner | — | — | — | — | Y | C | M | — | C | M | Y | — | — | — | C | — | Y | — | M | — | — | M | Y | C |
| Reproduction | | White | | | Green | | | Blue | | | Red | | | Cyan | | | Yellow | | | Magenta | | | Black | |

In the example of Table 13, the order of the whole surface exposures is made to be from red light through blue light to green light, and red color, green color, and blue color in the original are converted to blue color, red color, and green color, respectively. In this case, yellow, magenta, and cyan colors in the original are converted to magenta, cyan, and yellow colors, respectively.

In the example of Table 14, the order of the whole surface exposures is made to be from green light through red light to blue light, and red color, green color, and blue color in the original are converted to green color, blue color, and red color, respectively. In this case, yellow, magenta, and cyan colors in the original are converted to cyan, yellow, and magenta colors, respectively.

As described above, in making color conversion (some colors are reproduced as they are), desired color conversion is achieved by selecting the order of the whole surface exposures by the light of specific colors.

Figure 30:
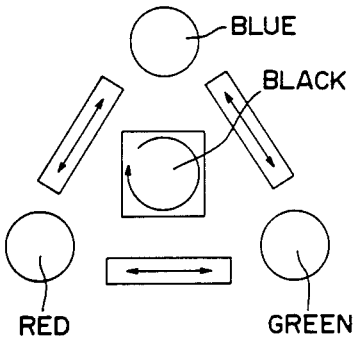
FIG. 30 shows converted color setting portion on the control panel.

FIG. 30 shows operating buttons provided on the control panel for instructing color conversion. Indications (BLUE), (GREEN), and (RED) are provided at the vertexes of an equilateral triangle and pushbuttons with a mark ⟷ are disposed on each side of the triangle. The operator can specify color conversion between desired two colors by operating a relevant button of these. When it is desired to make color conversion for all of the three colors, the operator can press the button in the center of the triangle with an indication (BLACK) thereon. Then, color conversion in sequence as indicated by the arrow is made. When such color conversion as red to green, green to blue, and blue to red is desired, the (BLACK) pushbutton is depressed twice.

Figure 31:
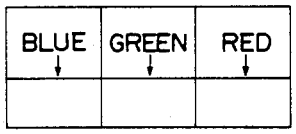
FIG. 31 shows converted color display portion on the control panel.

When any of these pushbuttons is pushed by the operator, relevant display under indication of "BLUE", "GREEN", and "RED" in FIG. 31 is lighted in the color to which the indicated color is to be converted.

Incidentally, in making the whole surface exposures as shown in Tables 1, 4, 13, and 14, the whole surface exposures to be made in the second and third stages may be carried out with such light as is including the exposure light component used in the whole surface exposure in the earlier stage, because there remains no charge on the photosensitive member after the whole surface exposure, development, and charge elimination in the earlier stage have been finished, and further, the toner already attached acts as a filter.

Color conversion by the use of the multicolor apparatus of FIG. 17 is achieved either by selecting the order of the whole surface exposures or by selecting the order of use of the developing devices. The former method is the one similar to what has already been described with reference to the above tables, and so, description of the latter method will only be given in the following with reference to Table 16.

TABLE 16

| | | | | | | | | | | | | | | | | | | | | | | | | |
|---|---|---|---|---|---|---|---|---|---|---|---|---|---|---|---|---|---|---|---|---|---|---|---|---|
| Original | | White | | | Red | | | Green | | | Blue | | | Yellow | | | Magenta | | | Cyan | | | Black | |
| Filter in Insulating Layer | R | G | B | R | G | B | R | G | B | R | G | B | R | G | B | R | G | B | R | G | B | R | G | B |
| Image Exposure | | | | | ◌ | ◌ | ◌ | | ◌ | ◌ | ◌ | | | | ◌ | | ◌ | | ◌ | | | ◌ | ◌ | |
| Blue Whole Surface Exposure | | | | | ↓ | ○ | ↓ | | ○ | ↓ | ↓ | | | | ○ | | ↓ | | ↓ | | | ↓ | ↓ | ○ |
| Cyan Development | | | | | | ◍ | | | ◍ | | | | | | ◍ | | | | | | | | | ◍ |
| Uniform Charging | | | | | ↓ | ↓ | ↓ | | ↓ | ↓ | ↓ | | | | ↓ | | ↓ | | ↓ | | | ↓ | ↓ | |
| Green Whole Surface Exposure | | | | | ↓ | | ↓ | | | ↓ | ○ | | | | | | ○ | | ↓ | | | ↓ | ○ | |
| Yellow Development | | | | | ◍ | | ↓ | | | ↓ | ◍ | | | | | | ◍ | | ↓ | | | ↓ | ◍ | |
| Uniform Charging | | | | | | | ↓ | | | ↓ | | | | | | | | | ↓ | | | ↓ | | |
| Red Whole Surface Exposure | | | | | | | ○ | | | ○ | | | | | | | | | ○ | | | ○ | | |

TABLE 16-continued

| | | | | | | | | | | | | | | | | | | | | | | | | | | |
|---|---|---|---|---|---|---|---|---|---|---|---|---|---|---|---|---|---|---|---|---|---|---|---|---|---|---|
| Magenta Development | | | | | | | | ◍ | | | | ◉ | | | | | | | | | | ◍ | | | | ◍ |
| Attached Toner | — | — | — | — | Y | C | M | — | C | M | Y | — | — | — | C | — | Y | — | M | — | — | M | Y | C |
| Reproduction | | | White | | Green | | | Blue | | | Red | | | Cyan | | | Yellow | | Magenta | | | Black | |

In Table 5 and Table 16, while the order of the whole surface exposures is made the same as in the case where colors of the original are reproduced as they are, the order of use of the developing devices is changed to achieve color conversion.

Table 5 shows the case where development is made in the order from cyan through magenta to yellow, and thereby, color conversion between red and blue is made in the same way as the previously described Table 4.

Table 16 shows the case where development is made in the order from cyan through yellow to magenta, and thereby, color conversion from red to green, from green to blue, and from blue to red as described in Table 17 is made.

Other modes of color conversion than that shown in Tables 5 and 16 also can of course be practiced by selection of the order of development.

As various modes of color conversion are made possible by selection of the order of the development, the order of the development is determined by the previously described color conversion instruction, and thereby, desired color conversion is performed.

Figure 29:
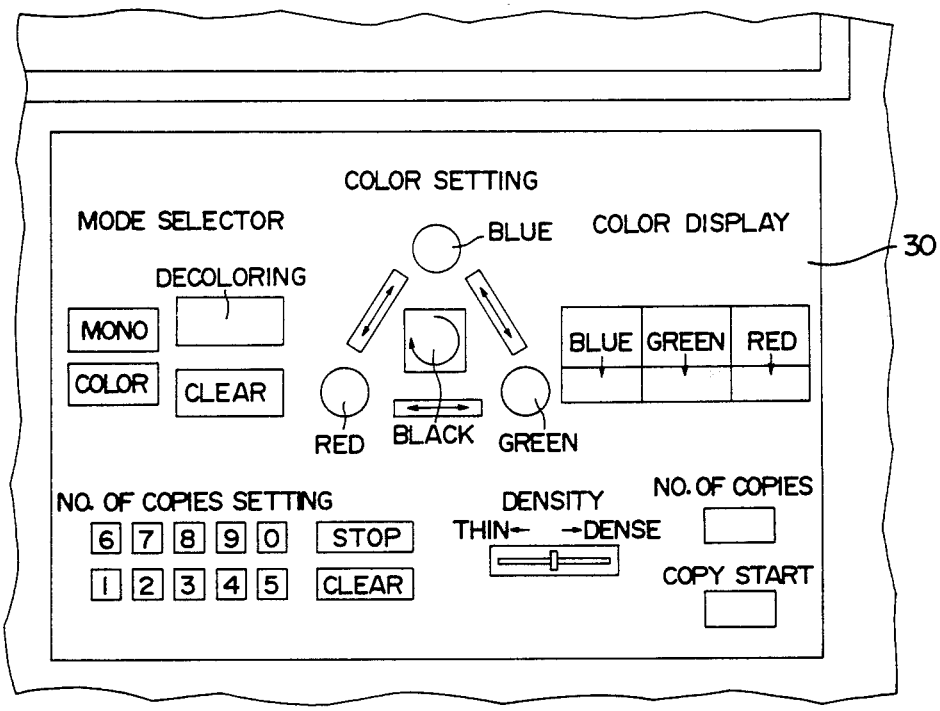
FIG. 29 is a plan view showing a control panel for an image forming apparatus of another embodiment of the present invention.

FIG. 29 is a plan view of the control panel for instructing color conversion.

In its color conversion setting portion are disposed the operating buttons for color conversion of FIG. 30 and the display for converted colors of FIG. 31. On the panel, there are further disposed operating pushbuttons for selecting full color or monochromatic mode, pushbutton for clearing, pushbutton for decoloring, pushbutton for density adjustment, pushbuttons for setting number of copies and clearing, and a display portion of set number of copies.

In the case where color conversion is not made, a white and black image is formed by pushing the "MONO" button, and a color reproduction faithful to the original is made by pushing the "COLOR" button.

In the case where color conversion is made, the "COLOR" button is first depressed and then a specific button in the color conversion setting portion is depressed. In the case of conversion between blue and green, for example, the "↔" button is pushed. In the case of converting blue to green, green to red, and red to blue, the (BLACK) button is depressed. In the case of converting blue to red, green to blue, and red to green, the (BLACK) button is depressed two times.

In the case where color conversion is made in the monochromatic mode, the "MONO" button is first pushed and then any specific button of (BLUE), (GREEN), (RED), or (BLACK) in the color conversion setting portion is pushed. If, for example, a red monochromatic image is desired, the (RED) button is pushed. Further, if decoloring is desired, the "DECOLORING" button is first pushed and then the button for the color to be decolored (if it is desired to decolor blue, the (BLUE) button) is pushed.

The color to be converted thereto is displayed by the color lamp corresponding to that color which is lighted in the converted color display portion.

Other portions on the control panel are the same as those in ordinary copying machines.

As described in the foregoing, since the multicolor image forming apparatus according to the present embodiment of the invention comprises, in combination, whole surface exposure means and developing means, which are disposed opposite to a photosensitive member having a surface insulating layer and provided with a color separation function in its surface, and is enabled to make color conversion of a specific color or colors in an original, the image formation is achieved thereby through one time of image exposure, and the formed image is free from shear in superimposed colors and provides high fidelity color reproduction. Besides, an image of good quality in which color conversion is made to desired colors can be provided through simple operations of the apparatus.

What is claimed is:

1. An image forming apparatus comprising image exposure means, whole surface exposure means by light of specific colors, and developing means, wherein each of said means is disposed opposite to a photosensitive member having a surface insulating layer and having a color separation function, and wherein a particular color in an original image is converted into another color by combination of said whole surface exposure and development.

2. The image forming apparatus according to claim 1, wherein the difference between developing potential contrasts at portions on said photosensitive member corresponding to color components provided by color separation is within 30% of the maximum developing potential contrast.

3. The image forming apparatus according to claim 1, wherein the difference between developing potential contrasts at portions on said photosensitive member corresponding to color components provided by color separation is within 15% of the maximum developing potential contrast.

4. The image forming apparatus according to claim 1, wherein the operating condition of said developing means can be changed according to image forming modes.

5. The image forming apparatus according to claim 4, wherein said operating condition is a duty ratio of a developing bias.

6. The image forming apparatus of claim 4 wherein said operating condition is based on a voltage of a d.c. component of a developing bias.

7. The image forming apparatus of claim 4 wherein said operating condition is based on a voltage of an a.c. component of a developing bias.

8. The image forming apparatus of claim 4 wherein said operating condition is based on a frequency of an a.c. component of a developing bias.

* * * * *